US010586520B2

(12) United States Patent
Maezawa

(10) Patent No.: US 10,586,520 B2
(45) Date of Patent: Mar. 10, 2020

(54) MUSIC DATA PROCESSING METHOD AND PROGRAM

(71) Applicant: Yamaha Corporation, Hamamatsu, Shizuoka (JP)

(72) Inventor: Akira Maezawa, Shizuoka (JP)

(73) Assignee: YAMAHA CORPORATION, Shizouka (JP)

( * ) Notice: Subject to any disclaimer, the term of this patent is extended or adjusted under 35 U.S.C. 154(b) by 0 days.

(21) Appl. No.: 16/252,245

(22) Filed: Jan. 18, 2019

(65) Prior Publication Data

US 2019/0156809 A1 May 23, 2019

Related U.S. Application Data

(63) Continuation of application No. PCT/JP2017/026270, filed on Jul. 20, 2017.

(30) Foreign Application Priority Data

Jul. 22, 2016 (JP) ..... 2016-144943

(51) Int. Cl.
*G10H 7/00* (2006.01)
*G10H 1/36* (2006.01)
(Continued)

(52) U.S. Cl.
CPC ..... *G10H 7/008* (2013.01); *G10G 1/00* (2013.01); *G10H 1/00* (2013.01); *G10H 1/361* (2013.01);
(Continued)

(58) Field of Classification Search
CPC ..... G10H 7/008; G10H 1/00; G10H 1/361; G10H 1/40; G10G 1/00
(Continued)

(56) References Cited

U.S. PATENT DOCUMENTS 8,791,350 B2 * 7/2014 Okazaki ..... G10H 1/38 84/604
10,262,639 B1 * 4/2019 Girardot ..... G10H 1/0008
(Continued)

FOREIGN PATENT DOCUMENTS

JP 2005-62697 A 3/2005
JP 2015-79183 A 4/2015

OTHER PUBLICATIONS

International Search Report in PCT/JP2017/026270 dated Oct. 10, 2017.

(Continued)

*Primary Examiner* — David S Warren
*Assistant Examiner* — Christina M Schreiber
(74) *Attorney, Agent, or Firm* — Global IP Counselors, LLP

(57) ABSTRACT

A music data processing method includes estimating a performance position within a musical piece, and updating a tempo designated by music data representing a performance content of the musical piece such that a tempo trajectory corresponds to a transition in a degree of dispersion of a performance tempo, which is generated as a result of estimating the performance position with respect to a plurality of performances of the musical piece, and the transition in the degree of dispersion of a reference tempo. The performance tempo is preferentially reflected in a portion of the musical piece in which the degree of dispersion of the performance tempo falls below the degree of dispersion of the reference tempo, and the reference tempo is preferentially reflected in a portion of the musical piece in which the degree of dispersion of the performance tempo exceeds the degree of dispersion of the reference tempo.

9 Claims, 8 Drawing Sheets

(51) Int. Cl.
*G10H 1/00* (2006.01)
*G10H 1/40* (2006.01)
*G10G 1/00* (2006.01)

(52) U.S. Cl.
CPC ..... *G10H 1/40* (2013.01); *G10H 2210/091* (2013.01); *G10H 2210/265* (2013.01); *G10H 2210/391* (2013.01); *G10H 2220/455* (2013.01); *G10H 2240/325* (2013.01); *G10H 2250/015* (2013.01)

(58) Field of Classification Search
USPC ..... 84/612
See application file for complete search history.

(56) References Cited

U.S. PATENT DOCUMENTS

2003/0205124 A1* 11/2003 Foote ..... G10G 1/00 84/608
2006/0101983 A1* 5/2006 Boxer ..... G04F 5/025 84/484
2007/0157797 A1* 7/2007 Hashizume ..... G10H 1/00 84/609
2008/0202321 A1* 8/2008 Goto ..... G10H 1/361 84/616
2014/0260911 A1* 9/2014 Maezawa ..... G10H 7/002 84/612
2017/0256246 A1* 9/2017 Maezawa ..... G10H 1/00
2019/0156801 A1* 5/2019 Maezawa ..... G10H 5/007
2019/0156806 A1* 5/2019 Maezawa ..... G10H 1/361
2019/0156809 A1* 5/2019 Maezawa ..... G10H 1/00
2019/0172433 A1* 6/2019 Maezawa ..... G10G 1/00
2019/0237055 A1* 8/2019 Maezawa ..... G10H 1/40

OTHER PUBLICATIONS

I Watanabe, "Automated Music Performance System by Real-time Acoustic Input Based on Multiple Agent Simulation", IPSJ SIG Notes, Nov. 13, 2014, vol. 2014-MUS-105, No. 14, pp. 1 to 4.
A Maezawa et al., "Ketsugo Doteki Model ni Motozuku Onkyo Shingo Alignment", IPSJ SIG Notes, Aug. 26, 2014, vol. 2014-MUS-104, No. 13, pp. 1 to 7.

* cited by examiner

MUSIC DATA PROCESSING METHOD AND PROGRAM

CROSS-REFERENCE TO RELATED APPLICATIONS

This application is a continuation application of International Application No. PCT/JP2017/026270, filed on Jul. 20, 2017, which claims priority to Japanese Patent Application No. 2016-144943 filed in Japan on Jul. 22, 2016. The entire disclosures of International Application No. PCT/JP2017/026270 and Japanese Patent Application No. 2016-144943 are hereby incorporated herein by reference.

BACKGROUND

Technological Field

The present invention relates to music data processing as used in automatic performances.

Background Information

A score alignment technique for estimating a position in a musical piece that is currently being played (hereinafter referred to as "performance position") by means of analyzing sounds of the musical piece being played has been proposed in the prior art (for example, Japanese Laid-Open Patent Application No. 2015-79183). For example, it is possible to estimate the performance position by comparing music data which represent the performance content of the musical piece with an audio signal that represents the sounds generated during the performance.

On the other hand, automatic performance techniques to make an instrument, such as keyboard instrument, generate sound using music data which represent the performance content of a musical piece are widely used. If the analysis results of the performance position are applied to an automatic performance, it is possible to achieve an automatic performance that is synchronized with the performance of a musical instrument by a performer. However, because an actual performance reflects the unique tendencies of the performer (for example, musical expressions and performance habits), it is difficult to estimate the performance position with high precision by means of estimations using music data prepared in advance, which are unrelated to the actual performance tendencies.

SUMMARY

In consideration of such circumstances, an object of the present disclosure is to reflect the actual performance tendencies in relation to music data.

In order to solve the problem described above, the music data processing method according to an aspect of this disclosure comprises estimating a performance position in a musical piece by analyzing an audio signal that represents a performance sound, and updating a tempo designated by music data that represent a performance content of the musical piece, such that a tempo trajectory corresponds to a transition in a degree of dispersion of a performance tempo, which is generated as a result of estimating the performance position with respect to a plurality of performances of the musical piece, and a transition in a degree of dispersion of a reference tempo, which is prepared in advance. The tempo designated by the music data is updated such that the performance tempo is preferentially reflected in a portion of the musical piece in which the degree of dispersion of the performance tempo falls below the degree of dispersion of the reference tempo, and the reference tempo is preferentially reflected in a portion of the musical piece in which the degree of dispersion of the performance tempo exceeds the degree of dispersion of the reference tempo.

A non-transitory computer readable medium storing a program according to an aspect of this disclosure causes a computer to function as a performance analysis module that estimates a performance position within a musical piece by analyzing an audio signal that represents a performance sound, and as a first updating module that updates a tempo designated by music data that represent a performance content of the musical piece, such that a tempo trajectory corresponds to a transition in a degree of dispersion of a performance tempo, which is generated as a result of estimating the performance position with respect to a plurality of performances of the musical piece, and a transition in a degree of dispersion of a reference tempo, which is prepared in advance. The first updating module updates the tempo designated by the music data, such that the performance tempo is preferentially reflected in a portion of the musical piece in which the degree of dispersion of the performance tempo falls below the degree of dispersion of the reference tempo, and the reference tempo is preferentially reflected in a portion of the musical piece in which the degree of dispersion of the performance tempo exceeds the degree of dispersion of the reference tempo.

DETAILED DESCRIPTION OF THE EMBODIMENTS

Selected embodiments will now be explained with reference to the drawings. It will be apparent to those skilled in the field of musical performances from this disclosure that the following descriptions of the embodiments are provided for illustration only and not for the purpose of limiting the invention as defined by the appended claims and their equivalents.

Automatic Performance System

Figure 1:
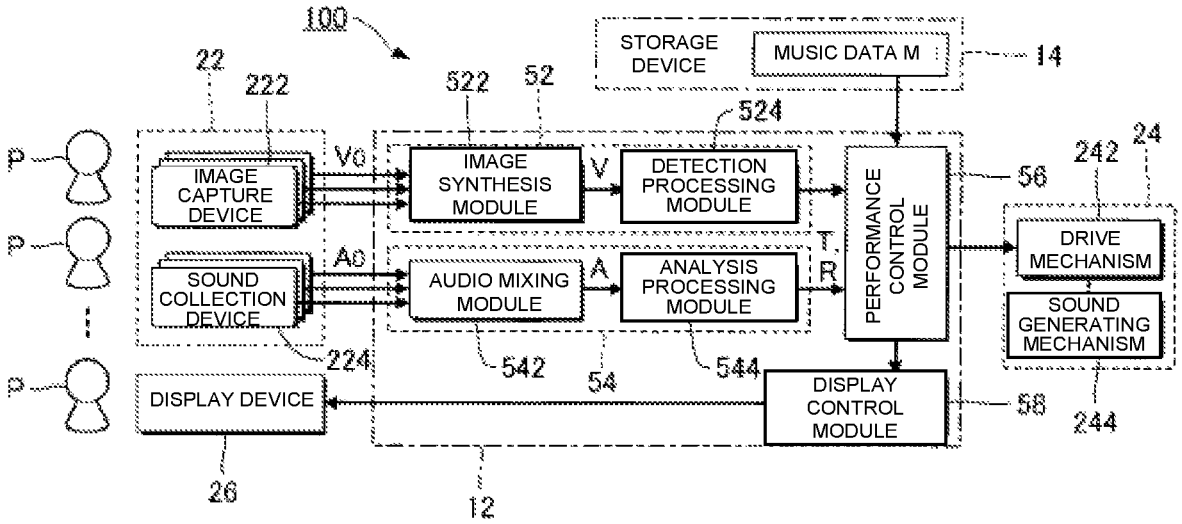
FIG. 1 is a block diagram of an automatic performance system according to an embodiment of a present disclosure.

FIG. 1 is a block diagram of an automatic performance system 100 according to a preferred embodiment. The automatic performance system 100 is a computer system that is installed in a space in which a plurality of performers P play musical instruments, such as a music hall, and that executes, parallel with the performance of a musical piece by the plurality of performers P (hereinafter referred to as "musical piece to be performed"), an automatic performance of the musical piece to be performed. While the performers P are typically performers of musical instruments, singers of the musical piece to be performed can also be the performers P. That is, the "performance" in the present application includes not only the playing of musical instruments, but also singing. In addition, those persons who are not responsible for actually playing a musical instrument (for example, a conductor at a concert or a sound director at the time of recording) can also be included in the performers P.

As illustrated in FIG. 1, the automatic performance system 100 according to the present embodiment comprises an electronic controller 12, a storage device 14, a recording device 22, an automatic performance device 24, and a display device 26. The electronic controller 12 and the storage device 14 are realized by an information processing device, such as a personal computer.

The term "electronic controller" as used herein refers to hardware that executes software programs. The electronic controller 12 is a processing circuit such as a CPU (Central Processing Unit) and has at least one processor. The electronic controller 12 can be configured to comprise, instead of the CPU or in addition to the CPU, programmable logic devices such as a DSP (Digital Signal Processor), an FPGA (Field Programmable Gate Array), etc. The electronic controller 12 comprehensively controls each module and device of the automatic performance system 100. The storage device 14 is configured from a known storage medium, such as a magnetic storage medium or a semiconductor storage medium, or from a combination of a plurality of types of storage media, and stores a program that is executed by the electronic controller 12, and various data that are used by the electronic controller 12. The storage device 14 can be a non-transitory storage medium, and be any computer storage device or any non-transitory computer readable medium with the sole exception of a transitory, propagating signal. For example, the storage device 14 can be nonvolatile memory and volatile memory, and can includes a ROM (Read Only Memory) device, a RAM (Random Access Memory) device, a hard disk, a flash drive, etc. The storage device 14 is preferably an optical storage medium such as a CD-ROM (optical disc). Moreover, the storage device 14 that is separate from the automatic performance system 100 (for example, cloud storage) can be prepared, and the electronic controller 12 can read from or write to the storage device 14 via a communication network, such as a mobile communication network or the Internet. That is, the storage device 14 can be omitted from the automatic performance system 100.

The storage device 14 of the present embodiment further stores music data M. The music data M designates a performance content of a musical piece to be performed by means of an automatic performance. For example, a file in a format conforming to the MIDI (Musical Instrument Digital Interface) standard (SMF: Standard MIDI File) is suitable as the music data M. Specifically, the music data M is time-series data, in which are arranged instruction data indicating the performance content and time data indicating the generation time point of said instruction data. The instruction data assign pitch (note number) and intensity (velocity), and provides instruction for various events, such as sound generation and muting. The time data designate, for example, an interval (delta time) for successive instruction data.

The automatic performance device 24 of FIG. 1 executes the automatic performance of the musical piece to be performed under the control of the electronic controller 12. Specifically, among the plurality of performance parts that constitute the musical piece to be performed, a performance part that differs from the performance parts of the plurality of performers P (for example, string instruments) is automatically performed by the automatic performance device 24. The automatic performance device 24 of the present embodiment is a keyboard instrument comprising a drive mechanism 242 and a sound generating mechanism 244 (that is, an automatic piano). The sound generating mechanism 244 is a string striking mechanism that causes a string (that is, a sound generating body) to generate sounds in conjunction with the displacement of each key of a keyboard. Specifically, the sound generating mechanism 244 comprises, for each key, a hammer that is capable of striking a string and an action mechanism constituting a plurality of transmitting members (for example, whippens, jacks, and repetition levers) that transmit the displacement of the key to the hammer. The drive mechanism 242 executes the automatic performance of the musical piece to be performed by driving the sound generating mechanism 244. Specifically, the drive mechanism 242 is configured comprising a plurality of driving bodies (for example, actuators, such as solenoids) that displace each key, and a drive circuit that drives each driving body. The automatic performance of the musical piece to be performed is realized by the drive mechanism 242 driving the sound generating mechanism 244 in accordance with instructions from the electronic controller 12. The electronic controller 12 or the storage device 14 can also be mounted on the automatic performance device 24.

The recording device 22 records the manner in which the plurality of the performers P play the musical piece to be performed. As illustrated in FIG. 1, the recording device 22 of the present embodiment comprises a plurality of image capture devices 222 and a plurality of sound collection devices 224. One image capture device 222 is installed for each of the performers P and generates an image signal V0 by imaging the performer P. The image signal V0 is a signal representing a moving image of the performer P. One sound collection device 224 is installed for each of the performers P and collects the sounds (for example, music sounds or singing sounds) generated by the performance of the performer P (for example, the playing of a musical instrument or singing) to generate an audio signal A0. The audio signal A0 represents the waveform of the sound. As can be understood from the description above, a plurality of image signals V0, obtained by imaging different performers P, and a plurality of audio signals A0, obtained by collecting the sounds that are played by the different performers P, are recorded. Moreover, the acoustic signal A0 that is output from an electric musical instrument, such as an electric string instrument, can also be used. Therefore, the sound collection device 224 can be omitted.

The electronic controller 12 has a plurality of functions for realizing the automatic performance of the musical piece to be performed (cue detection module 52; performance analysis module 54; performance control module 56; and display control module 58) by the execution of a program that is stored in the storage device 14. Moreover, the functions of the electronic controller 12 can be realized by a group of a plurality of devices (that is, a system), or, some or all of the functions of the electronic controller 12 can be realized by a dedicated electronic circuit. In addition, a server device, which is located away from the space in which the recording device 22, the automatic performance device 24, and the display device 26 are installed, such as a music hall, can realize some or all of the functions of the electronic controller 12.

Figure 2:
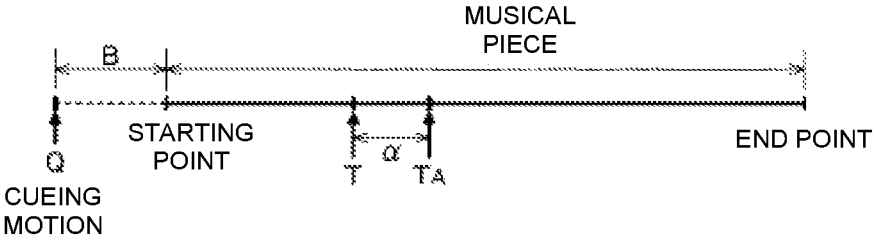
FIG. 2 is an explanatory view of cueing motion and performance position.

Each performer P makes a motion that serves as a cue (hereinafter referred to as "cueing motion") for the performance of the musical piece to be performed. The cueing motion is a motion (gesture) that indicates one point on a time axis. For example, the motion of the performer P picking up their musical instrument or the motion of the performer P moving their body are preferred examples of cueing motions. For example, as illustrated in FIG. 2, the particular performer P that leads the performance of the musical piece to be performed makes a cueing motion at time point Q, which occurs ahead of the starting point at which the performance of the musical piece to be performed should begin by a prescribed period of time (hereinafter referred to as "preparation period") B. The preparation period B is, for example, a period of time equal in length to one beat of the musical piece to be performed. Accordingly, the duration of the preparation period B varies according to the performance speed (tempo) of the musical piece to be performed. The preparation period B becomes shorter, for example, as the performance speed increases. The performer P makes the cueing motion at the timepoint that precedes the starting point of the musical piece to be performed by the duration of the preparation period B, which corresponds to one beat at the performance speed that is assumed for the musical piece to be performed, and then starts the performance of the musical piece to be performed upon the arrival of the starting point. As well as being used as a trigger for the automatic performance by the automatic performance device 24, the cueing motion serves as a trigger for the performance of the other performers P. The duration of the preparation period B is arbitrary, and can be, for example, a time length corresponding to a plurality of beats.

Figure 3:
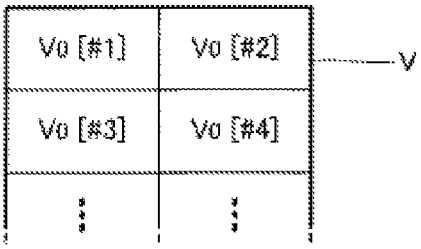
FIG. 3 is an explanatory view of image synthesis carried out by an image synthesis module.

The cue detection module 52 of FIG. 1 detects the cueing motion made by the performer P. Specifically, the cue detection module 52 detects the cueing motion by analyzing an image that captures the performer P taken by each image capture device 222. As illustrated in FIG. 1, the cue detection module 52 of the present embodiment comprises an image synthesis module 522 and a detection processing module 524. The image synthesis module 522 generates an image signal V by synthesizing a plurality of the image signals V0 that are generated by a plurality of the image capture devices 222. As illustrated in FIG. 3, the image signal V is a signal that represents an image in which a plurality of moving images (#1, #2, #3, . . . ) that are represented by each of the image signals V0 are arranged. That is, the image signal V that represents the moving images of the plurality of performers P are supplied from the image synthesis module 522 to the detection processing module 524.

The detection processing module 524 detects the cueing motion made by one of the plurality of performers P by analyzing the image signal V generated by the image synthesis module 522. A known image analysis technique, which includes an image recognition process for extracting, from an image, an element (such as a body or a musical instrument) that is moved at the time the performer P makes the cueing motion and a moving body detection process for detecting the movement of said element, can be used for detecting the cueing motion by means of the detection processing module 524. In addition, an identification model such as a neural network or a k-ary tree can be used to detect the cueing motion. For example, machine learning of the identification model (for example, deep learning) is performed in advance by using, as the given learning data, the feature amount extracted from the image signal capturing the performance of the plurality of performers P. The detection processing module 524 detects the cueing motion by applying the feature amount extracted from the image signal V of a scene in which the automatic performance is actually carried out to the identification model after machine learning.

The performance analysis module 54 in FIG. 1 sequentially estimates the position (hereinafter referred to as "performance position") T of the musical piece to be performed at which the plurality of performers P are currently playing, parallel with the performance of each performer P. Specifically, the performance analysis module 54 estimates the performance position T by analyzing the sounds that are collected by each of the plurality of sound collection devices 224. As illustrated in FIG. 1, the performance analysis module 54 of the present embodiment comprises an audio mixing module 542 and an analysis processing module 544. The audio mixing module 542 generates an audio signal A by mixing a plurality of the audio signals A0 that are generated by a plurality of the sound collection devices 224. That is, the audio signal A is a signal that represents a mixed sound of a plurality of types of sounds that are represented by the different audio signals A0.

The analysis processing module 544 estimates the performance position T by analyzing the audio signal A generated by the audio mixing module 542. For example, the analysis processing module 544 identifies the performance position T by crosschecking the sound represented by the audio signal A and the performance content of the musical piece to be performed indicated by the music data M. In addition, the analysis processing module 544 of the present embodiment estimates the performance speed (tempo) R of the musical piece to be performed by analyzing the audio signal A. For example, the analysis processing module 544 estimates the performance speed R from the temporal change in the performance position T (that is, the change in the performance position T in the time axis direction). A known audio analysis technique (score alignment) can be freely employed for the estimation of the performance position T and the performance speed R by the analysis processing module 544. For example, the analytical technique disclosed in Japanese Laid-Open Patent Application No. 2015-79183 can be used for estimating the performance position T and the performance speed R. In addition, an identification model such as a neural network or a k-ary tree can be used for estimating the performance position T and the performance speed R. For example, the feature amount extracted from the audio signal A that collects the sound of the performance by the plurality of performers P is used as the given learning data, and machine learning for generating the identification model (for example, deep learning) is executed before the automatic performance. The analysis processing module 544 estimates the performance position T and the performance speed R by applying the feature amount extracted from the audio signal A in a scene in which the automatic performance is actually carried out to the identification model generated by the machine learning.

The detection of the cueing motion by the cue detection module 52 and the estimation of the performance position T and the performance speed R by the performance analysis module 54 are executed in real time, parallel with the performance of the musical piece to be performed by the plurality of performers P. For example, the detection of the cueing motion and the estimation of the performance position T and the performance speed R are repeated at a prescribed cycle. However, the cycle of the detection of the cueing motion and the cycle of the estimation of the performance position T and the performance speed R can be the same or different.

The performance control module 56 of FIG. 1 causes the automatic performance device 24 to execute the automatic performance of the musical piece to be performed in synchronization with the cueing motion detected by the cue detection module 52 and the progress of the performance position T estimated by the performance analysis module 54. Specifically, the performance control module 56, triggered by the detection of the cueing motion by the cue detection module 52, provides instruction for the automatic performance device 24 to start the automatic performance, and also provides instruction for the automatic performance device 24 regarding the performance contents specified by the music data M with respect to the point in time that corresponds to the performance position T. In other words, the performance control module 56 is a sequencer that sequentially supplies each piece of instruction data included in the music data M of the musical piece to be performed to the automatic performance device 24. The automatic performance device 24 executes the automatic performance of the musical piece to be performed in accordance with the instructions from the performance control module 56. Since the performance position T moves forward toward the end point of the musical piece to be performed in the direction of the end of the musical piece as the performance of the plurality of performers P progresses, the automatic performance of the musical piece to be performed by the automatic performance device 24 will also progress with the movement of the performance position T. As can be understood from the foregoing explanation, the performance control module 56 provides instruction for the automatic performance device 24 to carry out the automatic performance so that the tempo of the performance and the timing of each sound will be synchronized with the performance of the plurality of performers P, while maintaining the intensity of each sound and the musical expressions, such as phrase expressions, of the musical piece to be performed, with regard to the content specified by the music data M. Thus, for example, if music data M that represent the performance of a specific performer (for example, a performer who is no longer alive) are used, it is possible to create an atmosphere as if the performer were cooperatively and synchronously playing together with a plurality of actual performers P, while accurately reproducing musical expressions that are unique to said performer by means of the automatic performance.

Moreover, time on the order of several hundred milliseconds is required for the automatic performance device 24 to actually generate a sound (for example, for the hammer of the sound generating mechanism 244 to strike a string), after the performance control module 56 provides instruction for the automatic performance device 24 to carry out the automatic performance by means of an output of instruction data. That is, the actual generation of sound by the automatic performance device 24 is inevitably delayed with respect to the instruction from the performance control module 56. Accordingly, a configuration in which the performance control module 56 provides instruction for the automatic performance device 24 to perform at the performance position T itself of the musical piece to be performed estimated by the performance analysis module 54, results in the delay of the generation of sound by the automatic performance device 24 with respect to the performance by the plurality of performers P.

Therefore, as illustrated in FIG. 2, the performance control module 56 of the present embodiment provides instruction for the automatic performance device 24 to perform at a time point TA, which is ahead (in the future) of the performance position T of the musical piece to be performed and which is estimated by the performance analysis module 54. That is, the performance control module 56 pre-reads the instruction data in the music data M of the musical piece to be performed such that the sound generation after the delay synchronizes with the performance by the plurality of performers P (for example, such that a specific musical note of the musical piece to be performed is played essentially simultaneously by the automatic performance device 24 and the performers P).

Figure 4:
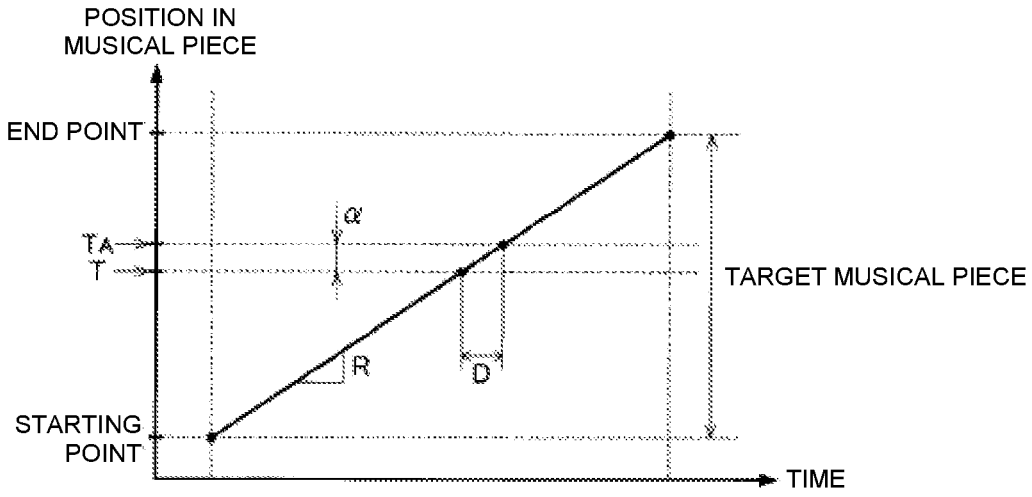
FIG. 4 is an explanatory view of the relationship between a performance position in a musical piece to be performed and an instructed position in an automatic performance.

FIG. 4 is an explanatory view of the temporal change in the performance position T. The amount of variation in the performance position T per unit time (the gradient of the straight line in FIG. 4) corresponds to the performance speed R. For the sake of convenience, FIG. 4 illustrates a case in which the performance speed R is held constant.

As illustrated in FIG. 4, the performance control module 56 provides instruction for the automatic performance device 24 to perform at the time point TA, which is ahead of the performance position T in the musical piece to be performed by an adjustment amount $\alpha$. The adjustment amount $\alpha$ is variably set in accordance with a delay amount D from the time of the instruction from the performance control module 56 for the automatic performance until the time that the automatic performance device 24 actually generates sound, and in accordance with the performance speed R estimated by the performance analysis module 54. Specifically, the length of a section in which the performance of the musical piece to be performed progresses within the period of time of the delay amount D at the performance speed R is set by the performance control module 56 as the adjustment amount $\alpha$. Therefore, the numerical value of the adjustment amount $\alpha$ increases with the performance speed R (i.e., as the gradient of the straight line of FIG. 4 becomes steeper). In FIG. 4, a case in which the performance speed R is held constant over the entire section of the musical piece to be performed is assumed, but in practice, the performance speed R can vary. Therefore, the adjustment amount $\alpha$ varies over time in conjunction with the performance speed R.

The delay amount D is set in advance to a prescribed value in accordance with the measurement result of the automatic performance device 24 (for example, from about several tens to several hundreds of milliseconds). In the actual automatic performance device 24, the delay amount D can differ depending on the pitch or the intensity of the sound that is played. Therefore, the delay amount D (as well as the adjustment amount $\alpha$, which depends on the delay amount D) can be variably set according to the pitch or the intensity of the musical note to be automatically played.

Figure 5:
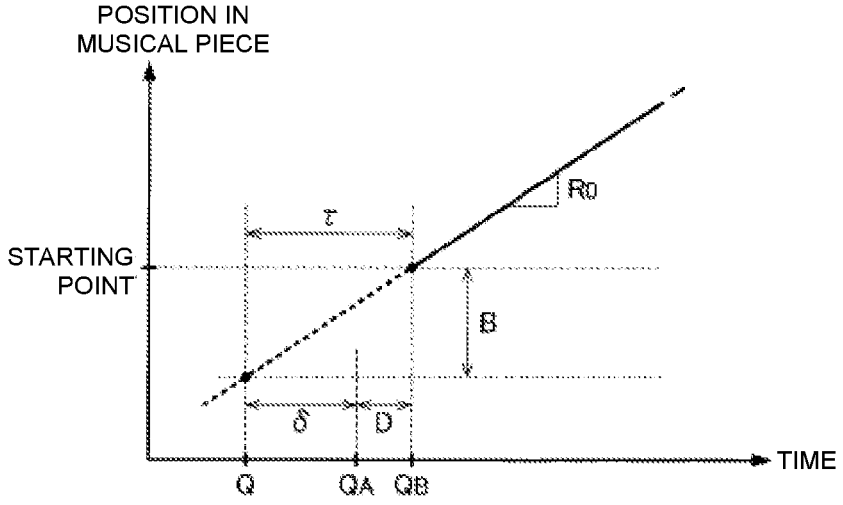
FIG. 5 is an explanatory view of the relationship between a position of the cueing motion and a starting point of the performance of the musical piece to be performed.

Furthermore, the performance control module 56, triggered by the cueing motion detected by the cue detection module 52, provides instruction for the automatic performance device 24 to start the automatic performance of the musical piece to be performed. FIG. 5 is an explanatory view of the relationship between the cueing motion and the automatic performance. As illustrated in FIG. 5, the performance control module 56 starts the instruction of the automatic performance to the automatic performance device 24 at a time point QA after a time length δ has elapsed from the time point Q at which the cueing motion is detected. The time length δ is the length of time obtained by subtracting the delay amount D of the automatic performance from a time length τ corresponding to the preparation period B. The time length τ of the preparation period B varies according to the performance speed R of the musical piece to be performed. Specifically, the time length τ of the preparation period B decreases as the performance speed R increases (i.e., as the gradient of the straight line of FIG. 5 becomes steeper). However, since the performance of the musical piece to be performed has not started at time point Q of the cueing motion, the performance speed R has not been estimated at this time. Therefore, the performance control module 56 calculates the time length τ of the preparation period B in accordance with a standard performance speed (standard tempo) R0 that is assumed for the musical piece to be performed. The performance speed R0 is specified, for example, in the music data M. However, a speed that is commonly recognized by the plurality of performers P regarding the musical piece to be performed (for example, the speed that is assumed during practice of the performance) can be set as the performance speed R0 as well.

As described above, the performance control module 56 starts the instruction of the automatic performance at the time point Q after a time length δ (δ=τ−D) has elapsed since the time point QA of the cueing motion. Therefore, sound generation by the automatic performance device 24 starts at time point QB after the preparation period B has elapsed since the time point Q of the cueing motion (that is, the point in time at which the plurality of performers P start to perform). That is, the automatic performance by the automatic performance device 24 starts essentially simultaneously with the start of the performance of the musical piece to be performed by the plurality of performers P. The control of the automatic performance by the performance control module 56 of the present embodiment is as illustrated above.

The display control module 58 of FIG. 1 causes the display device 26 to display an image (hereinafter referred to as "performance image") G that visually expresses the progress of the automatic performance of the automatic performance device 24. Specifically, the display control module 58 causes the display device 26 to display the performance image G by generating image data that represent the performance image G and outputting the image data to the display device 26. The display device 26 displays the performance image G as instructed by the display control module 58. For example, a liquid-crystal display panel or a projector is a preferred example of the display device 26. The plurality of performers P can visually check the performance image G displayed by the display device 26 at any time, parallel with the performance of the musical piece to be performed.

Figure 6:
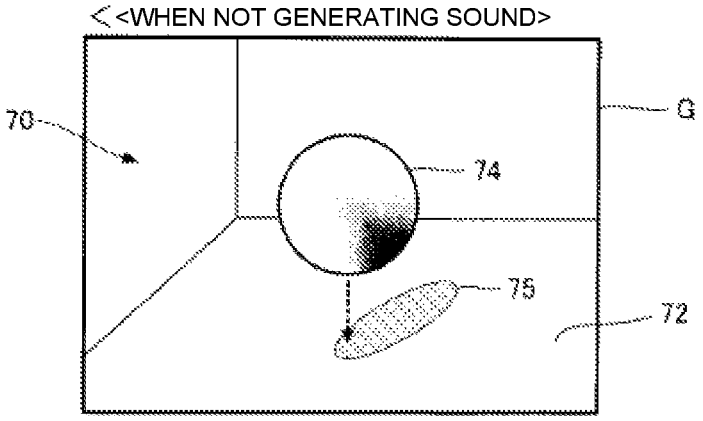
FIG. 6 is an explanatory view of a performance image.
Figure 7:
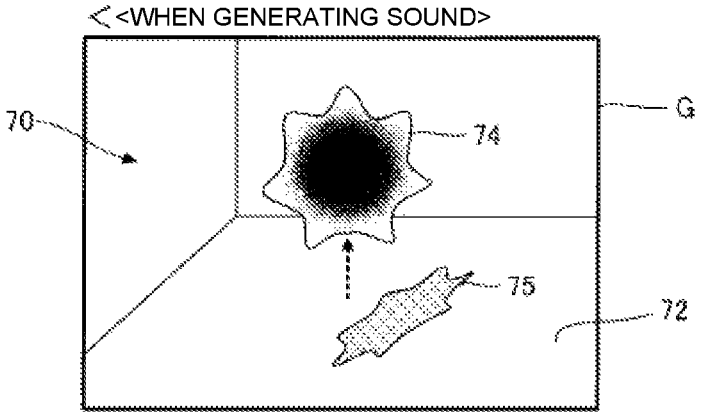
FIG. 7 is an explanatory view of a performance image.

The display control module 58 of the present embodiment causes the display device 26 to display a moving image, which changes dynamically in conjunction with the automatic performance of the automatic performance device 24, as the performance image G. FIGS. 6 and 7 show examples of displays of the performance image G. As illustrated in FIGS. 6 and 7, the performance image G is a three-dimensional image in which a display object (object) 74 is arranged in virtual space 70 that contains a bottom surface 72. As is illustrated in FIG. 6, the display object 74 is an essentially spherical solid that floats inside virtual space 70 and descends at a prescribed speed. A shadow 75 of the display object 74 is displayed on the bottom surface 72 of the virtual space 70, and as the display object 74 descends, the shadow 75 approaches the display object 74 on the bottom surface 72. As is illustrated in FIG. 7, the display object 74 rises to a prescribed height inside the virtual space 70 at the point in time at which the sound generated by the automatic performance device 24 begins, and the shape of the display object 74 deforms irregularly as the sound generation continues. Then, when the sound generation by the automatic performance stops (becomes muted), the display object 74 stops being irregularly deformed, returns to the initial shape (spherical) shown in FIG. 6, and transitions to a state in which the display object 74 descends at the prescribed speed. The behavior of the display object 74 described above (ascent and deformation) is repeated every time a sound is generated by the automatic performance. For example, the display object 74 descends before the start of the performance of the musical piece to be performed, and the direction of movement of the display object 74 switches from descending to ascending at the point in time at which the musical note of the starting point of the musical piece to be performed is generated by the automatic performance. Therefore, by visually checking the performance image G displayed on the display device 26, the performer P can grasp the timing of the sound generation of the automatic performance device 24 by the switch from descent to ascent of the display object 74.

The display control module 58 of the present embodiment controls the display device 26 to display the performance image G exemplified above. The delay from the time the display control module 58 provides instruction for the display device 26 to display or change the image until the time that the instruction is reflected in the displayed image on the display device 26 is sufficiently smaller than the delay amount D of the automatic performance by the automatic performance device 24. Therefore, the display control module 58 causes the display device 26 to display the performance image G corresponding to the performance content at the performance position T itself of the musical piece to be performed, as estimated by the performance analysis module 54. Thus, as described above, the performance image G changes dynamically in synchronization with the actual sound generated by the automatic performance device 24 (at the point in time that is delayed from the instruction of the performance control module 56 by delay amount D). That is, the movement of the display object 74 of the performance image G switches from descending to ascending at the point in time at which the automatic performance device 24 actually starts to generate the sound of each musical note of the musical piece to be performed. Therefore, the performers P can visually check the point in time at which the automatic performance device 24 generates each musical note of the musical piece to be performed.

Figure 8:
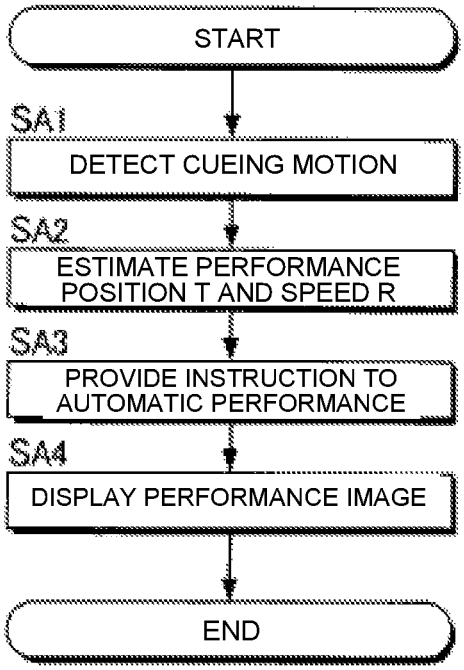
FIG. 8 is a flow chart of an operation of an electronic controller.

FIG. 8 is a flow chart illustrating the operation of the electronic controller 12 of the automatic performance system 100. For example, the process of FIG. 8, triggered by an interrupt signal that is generated at a prescribed cycle, is started parallel with the performance of the musical piece to be performed by the plurality of performers P. When the process of FIG. 8 is started, the electronic controller 12 (cue detection module 52) analyzes the plurality of image signals V0 supplied from the plurality of image capture devices 222 to thereby determine the presence/absence of the cueing motion by an arbitrary performer P (SA1). In addition, the electronic controller 12 (performance analysis module 54) analyzes the plurality of audio signals A0 supplied from the plurality of sound collection devices 224 to thereby estimate the performance position T and the performance speed R (SA2). The order of the detection of the cueing motion (SA1) and the estimation of the performance position T and the performance speed R (SA2) can be reversed.

The electronic controller 12 (performance control module 56) provides instruction to the automatic performance device 24 (SA3) regarding the automatic performance corresponding to the performance position T and the performance speed. Specifically, the electronic controller 12 causes the automatic performance device 24 to execute the automatic performance of the musical piece to be performed so as to be synchronized with the cueing motion detected by the cue detection module 52 and the progress of the performance position T estimated by the performance analysis module 54. In addition, the electronic controller 12 (display control module 58) causes the display device 26 to display the performance image G that represents the progress of the automatic performance (SA4).

In the embodiment exemplified above, the automatic performance of the automatic performance device 24 is carried out so as to be synchronized with the cueing motion of the performer P and the progress of the performance position T, while the display device 26 displays the performance image G representing the progress of the automatic performance of the automatic performance device 24. Thus, the performer P can visually check the progress of the automatic performance by the automatic performance device 24, and can reflect the visual confirmation in the performer's own performance. That is, a natural ensemble is realized in which the performance of the plurality of performers P and the automatic performance of the automatic performance device 24 interact. In particular, in the present embodiment, there is the benefit that the performer P can visually and intuitively grasp the progress of the automatic performance, since the performance image G, which changes dynamically in accordance with the performance content of the automatic performance, is displayed on the display device 26.

In addition, in the present embodiment the automatic performance device 24 is provided instruction regarding the performance content at time point TA, which is temporally subsequent to the performance position T, as estimated by the performance analysis module 54. Accordingly, even when the actual generation of sound by the automatic performance device 24 is delayed with respect to the instruction for the performance by the performance control module 56, it is possible to synchronize the performance of the performer P and the automatic performance with high precision. In addition, the automatic performance device 24 is instructed to perform at the time point TA, which is ahead of the performance position T by the adjustment amount $\alpha$ that varies in accordance with the performance speed R as estimated by the performance analysis module 54. Accordingly, for example, even when the performance speed R varies, the performance of the performer and the automatic performance can be synchronized with high precision.

Updating of Music Data

Figure 9:
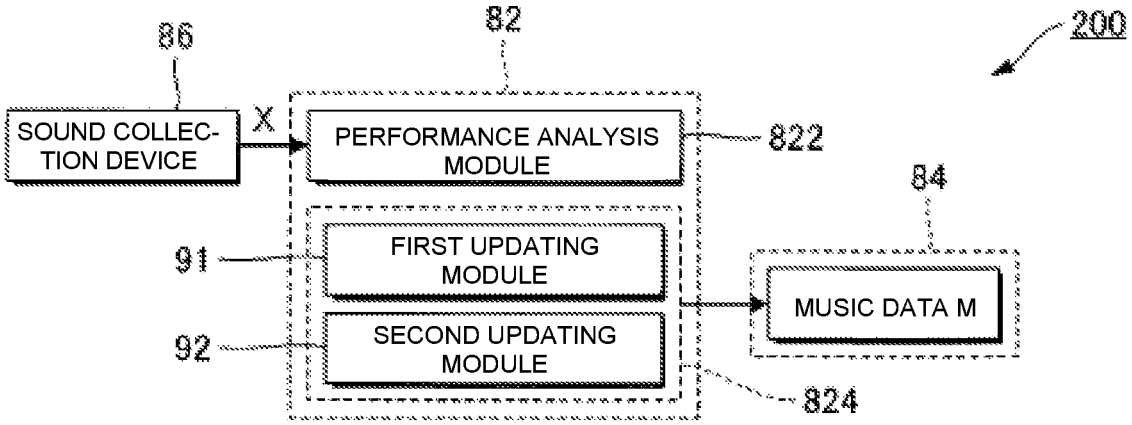
FIG. 9 is a block diagram of a music data processing device.

The music data M that are used in the automatic performance system 100 exemplified above are generated by, for example, the music data processing device 200 illustrated in FIG. 9. The music data processing device 200 comprises an electronic controller 82, a storage device 84, and a sound collection device 86. The electronic controller 82 is a processing circuit, such as a CPU, and comprehensively controls each module and device of the music data processing device 200. The term "electronic controller" as used herein refers to hardware that executes software programs. The electronic controller 82 includes at least one processor. The electronic controller 82 can be configured to comprise, instead of the CPU or in addition to the CPU, programmable logic devices such as a DSP (Digital Signal Processor), an FPGA (Field Programmable Gate Array), etc. The storage device 84 is configured from a known storage medium, such as a magnetic storage medium or a semiconductor storage medium, or from a combination of a plurality of types of storage media, and stores a program that is executed by the electronic controller 82, and various data that are used by the electronic controller 82. The storage device 84 can be a non-transitory computer-readable medium, and be any computer storage device or any computer readable medium with the sole exception of a transitory, propagating signal. For example, the storage device 84 can be nonvolatile memory and volatile memory, and can includes a ROM (Read Only Memory) device, a RAM (Random Access Memory) device, a hard disk, a flash drive, etc. Moreover, the storage device 84 that is separate from the music data processing device 200 (for example, cloud storage) can be prepared, and the electronic controller 82 can read from or write to the storage device 84 via a communication network, such as a mobile communication network or the Internet. That is, the storage device 84 can be omitted from the music data processing device 200. The storage device 84 of the first embodiment stores the music data M of the musical piece to be performed. The sound collection device 86 collects sounds (for example, musical sounds or singing sounds) generated by the performance of musical instruments by one or a plurality of performers, to generate an audio signal X.

The music data M processing device 200 is a computer system that reflects the performance tendencies of the performer with respect to the musical instrument, by updating the music data M of the musical piece to be performed in accordance with the audio signal X of the musical piece to be performed generated by the sound collection device 86. Thus, the music data processing device 200 updates the music data M before the execution of the automatic performance by the automatic performance system 100 (for example, at the time of a rehearsal for a concert). As illustrated in FIG. 9, by executing a program stored in the storage device 84, the electronic controller 82 realizes a plurality of functions (performance analysis module 822 and update processing module 824) for updating the music data M according to the audio signal X. Moreover, a configuration in which the functions of the electronic controller 82 are realized by a group of a plurality of devices (that is, a system), or a configuration in which some or all of the functions of the electronic controller 82 are realized by a dedicated electronic circuit, can also be employed. In addition, the music data processing device 200 can be installed in the automatic performance system 100 by means of the electronic controller 12 of the automatic performance system 100 functioning as the performance analysis module 822 and the update processing module 824. The performance analysis module 54 described above can also be utilized as the performance analysis module 822.

The performance analysis module 822 estimates a performance position within a musical piece by analyzing an audio signal that represents a performance sound. More specifically, the performance analysis module 822 estimates the performance position T within the musical piece to be performed where the performer is currently playing, by comparing the music data M that are stored in the storage device 84 and the audio signal X generated by the sound collection device 86. A processing similar to that of the performance analysis module 54 of the first embodiment is suitably employed for the estimation of the performance position T by the performance analysis module 822.

The update processing module 824 updates the music data M of the musical piece to be performed according to the estimation result of the performance position T by the performance analysis module 822. Specifically, the update processing module 824 updates the music data M such that the performer's performance tendencies (for example, performance or singing habits unique to the performer) are reflected. For example, tendencies in the changes in the tempo (hereinafter referred to as "performance tempo") and volume (hereinafter referred to as "performance volume") of the performer's performance are reflected in the music data M. That is, music data M are generated that reflect the musical expressions unique to the performer.

As illustrated in FIG. 9, the update processing module 824 is configured comprising a first updating module 91 and a second updating module 92. The first updating module 91 reflects the tendency of the performance tempo in the music data M. In particular, the first updating module 91 updates a tempo designated by music data that represent a performance content of the musical piece, such that a tempo trajectory corresponds to a transition in a degree of dispersion of a performance tempo, which is generated as a result of estimating the performance position with respect to a plurality of performances of the musical piece, and a transition in a degree of dispersion of a reference tempo, which is prepared in advance. The first updating module 91 updates the tempo designated by the music data such that the performance tempo is preferentially reflected in a portion of the musical piece in which the degree of dispersion of the performance tempo falls below the degree of dispersion of the reference tempo, and the reference tempo is preferentially reflected in a portion of the musical piece in which the degree of dispersion of the performance tempo exceeds the degree of dispersion of the reference tempo. The second updating module 92 reflects the tendency of the performance volume in the music data M. In particular, the second updating module 92 updates a basis vector of each of a plurality of musical notes, which represents a spectrum of a performance sound that corresponds to each of the plurality of musical notes, and a change in a volume designated for each of the plurality of musical notes by the music data, such that a reference matrix, obtained by adding, for the plurality of the musical notes, a product of the basis vector and a coefficient vector that represents the change in the volume designated for each of the plurality of musical notes by the music data, approaches an observation matrix that represents a spectrogram of the audio signal. The second updating module 92 expands or contracts the change in the volume designated for each of the plurality of musical notes by the music data on a time axis in accordance with a result of the estimating of the performance position, and uses a coefficient matrix that represents the change in the volume that has been expanded or contracted.

Figure 10:
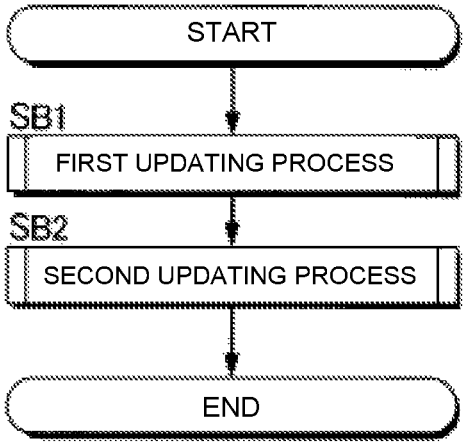
FIG. 10 is a flow chart of the operation of an update processing module.

FIG. 10 is a flow chart exemplifying the content of the processing that is executed by the update processing module 824. For example, the process shown in FIG. 10 is started in accordance with an instruction from a user. When the process is started, the first updating module 91 executes a process (hereinafter referred to as "first updating process") for reflecting the performance tempo on the music data M (SB). The second updating module 92 executes a process (hereinafter referred to as "second updating process") for reflecting the performance volume in the music data M (SB2). The order of the first updating process SB1 and the second updating process SB2 are arbitrary. The electronic controller 82 can also execute the first updating process SB11 and the second updating process SB2 in parallel.

First Updating Module 91

Figure 11:
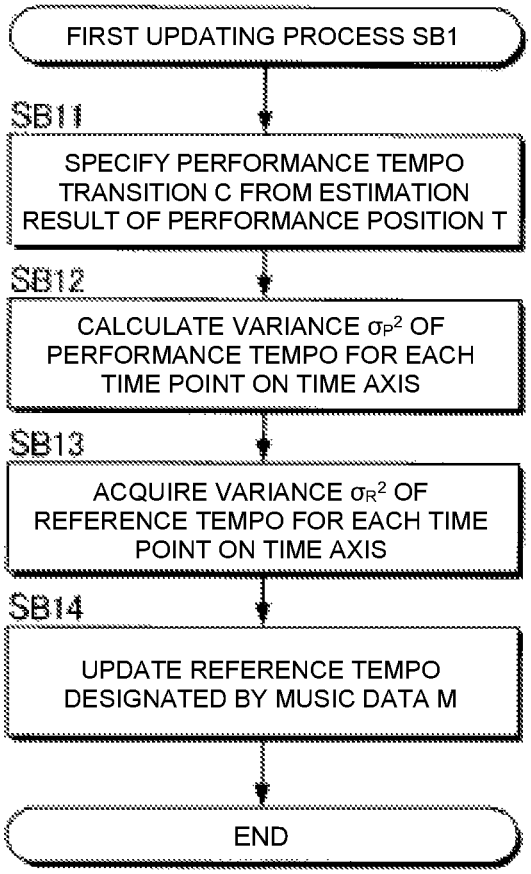
FIG. 11 is a flow chart of a first update process.
Figure 12:
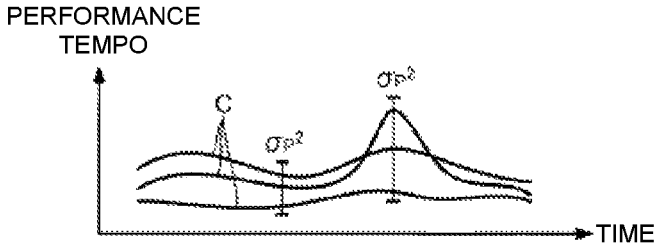
FIG. 12 is an explanatory view of transitions of performance tempo.

FIG. 11 is a flow chart illustrating the specific content of the first updating process SB1. The first updating module 91 analyzes a transition (hereinafter referred to as "performance tempo transition") C of the performance tempo on the time axis from the result of the estimation of the performance position T by the performance analysis module 822 (SB11). Specifically, the performance tempo transition C is specified by using the temporal change in the performance position T (specifically, the amount of change in the performance position T per unit time) as the performance tempo. The analysis of the performance tempo transition C is carried out for each of a plurality of times (K times) of the performance of the musical piece to be performed. That is, as shown in FIG. 12, K performance tempo transitions C are specified. The first updating module 91 calculates the variance $\sigma P^2$ of the K performance tempos for each of a plurality of time points within the musical piece to be performed (SB12). As can be understood from FIG. 12, the variance $\sigma P^2$ at any one point in time is an index (degree of dispersion) of the range over which the performance tempos are distributed at said time point in K performances.

The storage device 84 stores the variance $\sigma R^2$ of the tempo (hereinafter referred to as "reference tempo") designated by the music data M for each of a plurality of time points within the musical piece to be performed. The variance $\sigma R^2$ is an index of an allowable error range with respect to the reference tempo designated by the music data M (that is, the range in which allowable tempos are distributed) and is prepared in advance by the creator of the music data M. The first updating module 91 acquires the variance $\sigma R^2$ of the reference tempo for each of the plurality of time points within the musical piece to be performed from the storage device 84 (SB13).

The first updating module 91 updates the reference tempo designated by the music data M of the musical piece to be performed, such that the tempo trajectory corresponds to the transition of the degree of dispersion of the performance tempo (that is, the time series of the variance $\sigma P^2$) and the transition of the degree of dispersion of the reference tempo (that is, the time series of the variance $\sigma R^2$) (SB14). For example, a Bayesian estimation is suitably used for determining the updated reference tempo. Specifically, the first updating module 91 preferentially reflects the performance tempo in the music data M, compared with the reference tempo, regarding at least one or more portions of the musical piece to be performed in which the variance $\sigma P^2$ of the performance tempo falls below the variance $\sigma R^2$ of the reference tempo ($\sigma P^2 < \sigma R^2$). That is, the reference tempo designated by the music data M approaches the performance tempo. Specifically, the tendency of the performance tempo is preferentially reflected by preferentially reflecting the performance tempo in the music data M, regarding at least one or more portions of the musical piece to be performed in which there tends to be few errors in the performance tempo (that is, the at least one or more portions in which the variance $\sigma P^2$ is small). On the other hand, the reference tempo is preferentially reflected in the music data M, compared with the performance tempo, regarding at least one or more portions of the musical piece to be performed in which the variance $\sigma P^2$ of the performance tempo exceeds the variance $\sigma R^2$ of the reference tempo ($\sigma P^2 > \sigma R^2$). That is, the effect is in the direction in which the reference tempo designated by the music data M is maintained.

According to the configuration described above, it is possible to reflect the actual performance tendencies of the performer (specifically, the tendency of the variation in the performance tempo) in the music data M. Accordingly, a natural performance that reflects the performance tendencies of the performer can be achieved by utilizing the music data M processed by the music data processing device 200 in the automatic performance by the automatic performance system 100.

Second Updating Module 92

Figure 13:
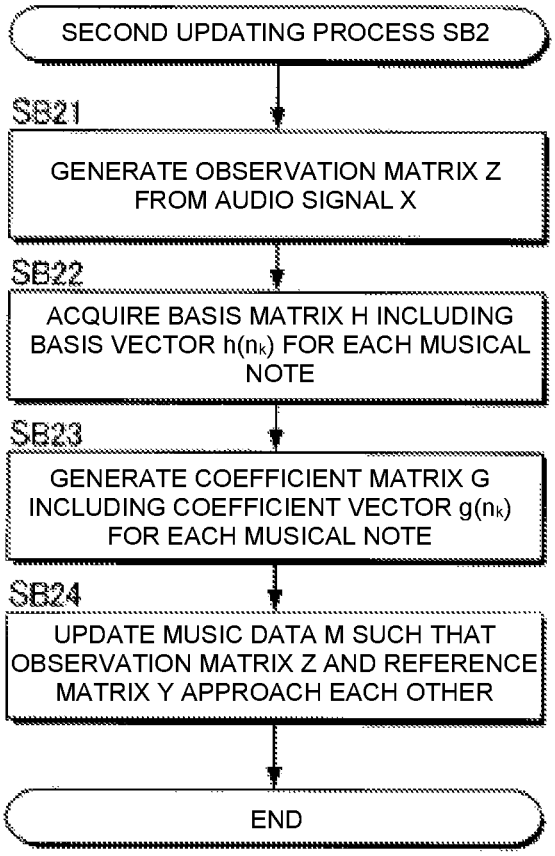
FIG. 13 is a flow chart of a second update process.
Figure 14:
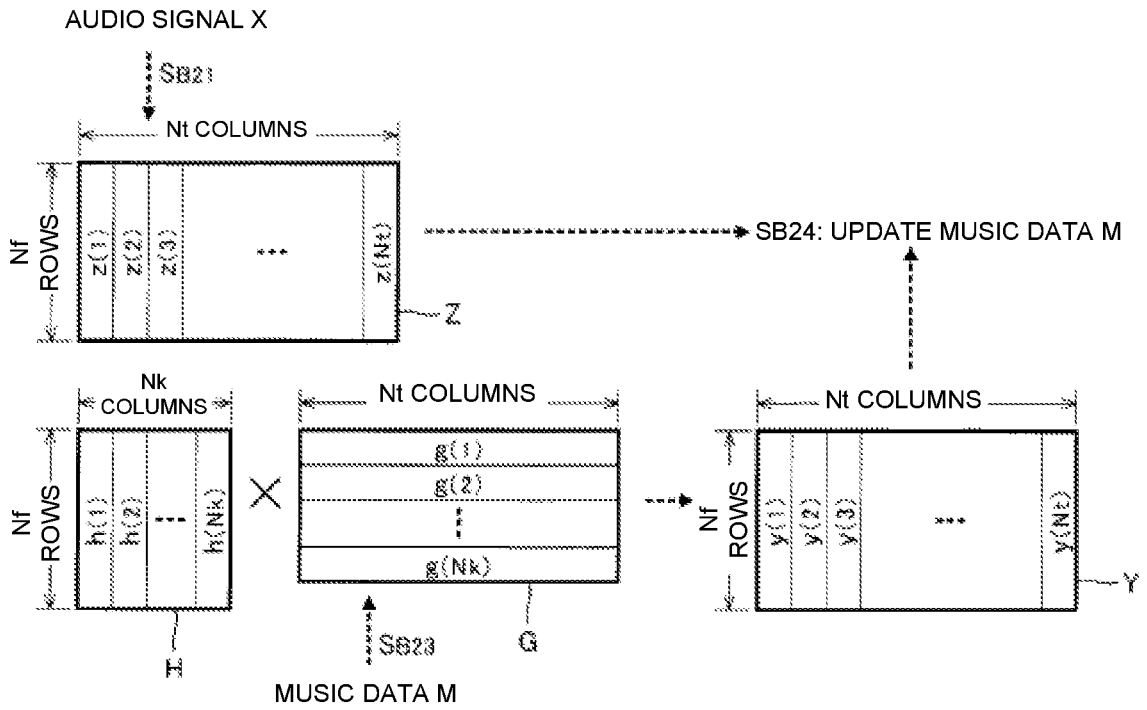
FIG. 14 is an explanatory view of the second update process.

FIG. 13 is a flow chart illustrating the specific content of the second updating process SB2 executed by the second updating module 92, and FIG. 14 is an explanatory view of the second updating process SB2. As illustrated in FIG. 14, the second updating module 92 generates an observation matrix Z from the audio signal X (SB21). The observation matrix Z represents a spectrogram of the audio signal X. Specifically, as illustrated in FIG. 14, the observation matrix Z is a nonnegative matrix of $N_f$ rows and $N_t$ columns, in which $N_t$ observation vectors z(1) to $z(N_t)$, which respectively correspond to $N_t$ time points on the time axis, are arranged horizontally. Any one observation vector $z(n_t)$ ($n_t$=1 to $N_t$) is an $N_t$-dimensional vector representing an intensity spectrum (amplitude spectrum or power spectrum) of the audio signal X at the $n_t$-th time point on the time axis.

The storage device 84 stores a basis matrix H. As illustrated in FIG. 14, the basis matrix H is a nonnegative matrix of $N_f$ rows and $N_k$ columns, in which $N_k$ basis vectors h(1) to $h(N_k)$, which respectively correspond to $N_k$ musical notes that could be played in the musical piece to be performed, are arranged horizontally. The basis vector $h(n_k)$ ($n_k$=1 to $N_k$) that corresponds to any one musical note is the intensity spectrum (for example, amplitude spectrum or power spectrum) of the performance sound that corresponds to said musical note. The second updating module 92 acquires the basis matrix H from the storage device 84 (SB22).

The second updating module 92 generates a coefficient matrix G (SB23). As illustrated in FIG. 14, the coefficient matrix G is a nonnegative matrix of $N_k$ rows and $N_t$ columns, in which coefficient vectors g(1) to $g(N_k)$ are arranged vertically. Any one coefficient vector $g(n_k)$ is an $N_t$-dimensional vector that represents the change in the volume regarding the musical note that corresponds to one basis vector $h(n_k)$ within the basis matrix H. Specifically, the second updating module 92 generates an initial coefficient matrix G0, which represents the transition of the volume (sound generation/mute) on the time axis regarding each of the plurality of musical notes from the music data M, and expands/contracts the coefficient matrix G0 on the time axis to thereby generate the coefficient matrix G. Specifically, the second updating module 92 generates the coefficient matrix G, which represents the change in the volume of each musical note over the time length that is equivalent to the audio signal X, by expanding/contracting the coefficient matrix G0 on the time axis according to the result of the estimation of the performance position T by the performance analysis module 822. In particular, the change in the volume designated for each musical note by the music data M is expanded or contracted on the time axis in accordance with the performance position T that has been estimated by the performance analysis module 822.

As can be understood from the description above, the product $h(n_k)g(n_k)$ of the basis vector $h(n_k)$ and the coefficient vector $g(n_k)$ that correspond to any one musical note corresponds to the spectrogram of said musical note in the musical piece to be performed. The matrix (hereinafter referred to as "reference matrix") Y obtained by adding the product $h(n_k)g(n_k)$ of the basis vector $h(n_k)$ and the coefficient vector $g(n_k)$ regarding a plurality of the musical notes corresponds to the spectrogram of the performance sounds when the musical piece to be performed is played in accordance with the music data M. Specifically, as illustrated in FIG. 14, the reference matrix Y is a nonnegative matrix of $N_f$ rows and $N_t$ columns, in which vectors y(1) to $y(N_t)$, represent the intensity spectrum of the performance sounds, are arranged horizontally.

The second updating module 92 updates the music data M and the basis matrix H stored in the storage device 84 such that the reference matrix Y described above approaches the observation matrix Z, which represents the spectrogram of the audio signal X (SB24). Specifically, the change in volume that is designated by the music data M for each musical note is updated such that the reference matrix Y approaches the observation matrix Z. For example, the second updating module 92 iteratively updates the basis matrix H and the music data M (coefficient matrix G) such that an evaluation function that represents the difference between the observation matrix Z and the reference matrix Y is minimized. KL distance (or i-divergence) between the observation matrix Z and the reference matrix Y is suitable as the evaluation function. For example, a Bayesian estimation (particularly variational Bayesian method) is suitably used for minimizing the evaluation function.

By means of the configuration described above, the music data M can be made to reflect the trend in the variation of the performance volume when the performer actually plays the musical piece to be performed. Accordingly, a natural performance that reflects the tendency of the performance volume can be achieved by utilizing the music data M processed by the music data processing device 200 in the automatic performance by the automatic performance system 100.

Modified Example

Each of the embodiments exemplified above can be variously modified. Specific modified embodiments are illustrated below. Two or more embodiments arbitrarily selected from the following examples can be appropriately combined as long such embodiments do not contradict one another.

(1) In the above-mentioned embodiment the starting of the automatic performance of the target musical piece was triggered by the cueing motion detected by the cue detection module 52, but the cueing motion can also be used to control the automatic performance at a midpoint of the musical piece to be performed. For example, at a point in time in which a long rest in the musical piece to be performed ends and the performance is restarted, the automatic performance of the musical piece to be performed is resumed by means of the cueing motion acting as a trigger, in the same manner as in each of the above-mentioned embodiments. For example, in the same manner as the behavior described with reference to FIG. 5, a specific performer P makes the cueing motion at the time point Q, which is earlier, by amount of time equal to the preparation period B, than the point in time at which the performance is restarted after a rest in the musical piece to be performed. Then, the performance control module 56 restarts the instruction of the automatic performance to the automatic performance device 24 at a point in time after the time length δ, which corresponds to the delay amount D and the performance speed R, has elapsed since the time point Q. Since the performance speed R has already been estimated at a time point in the middle of the musical piece to be performed, the performance speed R estimated by the performance analysis module 54 is applied to the setting of the time length δ.

Moreover, the time period during which the cueing motion can be made within the musical piece to be performed can be grasped in advance from the performance content of the musical piece to be performed. Therefore, the cue detection module 52 can monitor for the presence/absence of the cueing motion during specific periods (hereinafter referred to as "monitoring periods") during which the cueing motion can be made within the musical piece to be performed. For example, the storage device 14 stores section designation data, which designate the starting point and end point for each of a plurality of monitoring periods that can be assumed for the musical piece to be performed. The section designation data can also be included in the music data M. The cue detection module 52 monitors for the cueing motion when the performance position T is present within each of the monitoring periods designated by the section designation data in the musical piece to be performed and stops the monitoring for the cueing motion when the performance position T is outside of the monitoring periods. According to the configuration described above, since the cueing motion is detected only during the monitoring periods in the musical piece to be performed, there is the benefit that the processing load on the cue detection module 52 is reduced, compared with a configuration in which monitoring for the presence/absence of the cueing motion is carried out over the entire section of the musical piece to be performed. In addition, it is also possible to reduce the likelihood of an erroneous detection of the cueing motion during periods of the musical piece to be performed in which the cueing motion cannot actually be made.

(2) In the above-mentioned embodiment, the cueing motion is detected by analyzing the entire image (FIG. 3) represented by the image signal V, but the cue detection module 52 can monitor for the presence/absence of the cueing motion in specific areas (hereinafter referred to as "monitoring areas") of the image represented by the image signal V. For example, the cue detection module 52 selects as the monitoring area an area that includes the specific performer P scheduled to make the cueing motion within the image represented by the image signal V, and detects the cueing motion within the monitoring area. Areas outside of the monitoring area are omitted from the monitoring target by the cue detection module 52. By means of the configuration described above, since the cueing motion is detected only within the monitoring area, there is the benefit that the processing load on the cue detection module 52 is reduced, compared with a configuration in which monitoring for the presence/absence of the cueing motion is carried out over the entire image represented by the image signal V. In addition, it is also possible to reduce the likelihood that a motion made by a performer P that does not actually made the cueing motion is erroneously determined to be the cueing motion.

As exemplified in the modified example (1) described above, assuming that the cueing motion is made a plurality of times during the performance of the musical piece to be performed, it is possible that all of the cueing motions will not be made by the same performer P. For example, a performer P1 makes the cueing motion before the musical piece to be performed starts, whereas a performer P2 makes the cueing motion in the middle of the musical piece to be performed. Therefore, a configuration in which the position (or size) of the monitoring area of the image that is represented by the image signal V is changed over time is also suitable. Since the performers P that make the cueing motion are determined before the performance, for example, area designation data that designate the locations of the monitoring areas in a time sequence are stored in the storage device 14 in advance. The cue detection module 52 monitors for the cueing motion in each of the monitoring areas within the image represented by the image signal V designated by the area designation data and omits the areas outside of the monitoring areas from the monitoring targets for the cueing motion. By means of the configuration described above, it is possible to appropriately detect the cueing motion even when the performer P that makes the cueing motion changes with the progression of the musical piece.

(3) In the above-mentioned embodiment, images of the plurality of performers P were captured using the plurality of image capture devices 222, but an image of the plurality of performers P (for example, an image of the entire stage on which the plurality of performers P are located) can be captured by means of one image capture device 222. Similarly, the sound played by the plurality of performers P can be collected by means of a single sound collection device 224. In addition, a configuration in which the cue detection module 52 monitors for the presence/absence of the cueing motion in each of the plurality of image signals V0 can be employed as well (accordingly, the image synthesis module 522 can be omitted).

(4) In the above-mentioned embodiment, the cueing motion is detected by analyzing the image signal V captured by the image capture device 222, but the method for detecting the cueing motion with the cue detection module 52 is not limited to the example described above. For example, the cue detection module 52 can detect the cueing motion of the performer P by analyzing a detection signal from a detector (for example, various sensors such as an acceleration sensor) mounted on the body of the performer P. However, the configuration of the above-mentioned embodiment in which the cueing motion is detected by analyzing the image captured by the image capture device 222 has the benefit of the ability to detect the cueing motion with reduced influence on the performance motion of the performer P, compared to a case in which a detector is mounted on the body of the performer P.

(5) In the above-mentioned embodiment, the performance position T and the performance speed R are estimated by analyzing the audio signal A obtained by mixing the plurality of audio signals A0, which represents the sounds of different musical instruments, but the performance position T and the performance speed R can also be estimated by analyzing each of the audio signals A0. For example, the performance analysis module 54 estimates temporary performance position T and performance speed R using the same method as the above-mentioned embodiment for each of the plurality of audio signals A0 and determines the final performance position T and performance speed R from the estimation result regarding each of the audio signals A0. For example, representative values (for example, average values) of the performance position T and the performance speed R estimated from each audio signal A0 are calculated as the final performance position T and performance speed R. As can be understood from the description above, the audio mixing module 542 of the performance analysis module 54 can be omitted.

(6) As exemplified in the above-described embodiment, the automatic performance system 100 is realized by cooperation between the electronic controller 12 and the program. A program according to a preferred aspect of the present embodiment causes a computer to function as the cue detection module 52 for detecting the cueing motion of the performer P that performs the musical piece to be performed; as the performance analysis module 54 for sequentially estimating the performance position T within the musical piece to be performed by analyzing the audio signal A, which represents the sound that is played, parallel with the performance; as the performance control module 56 that causes the automatic performance device 24 to carry out the automatic performance of the musical piece to be performed so as to be synchronized with the cueing motion detected by the cue detection module 52 and the progress of the performance position T estimated by the performance analysis module 54; and as the display control module 58 that causes the display device 26 to display the performance image G, which represents the progress of the automatic performance. That is, the program according to the preferred aspect of the present embodiment is a program that causes the computer to execute the music data processing method according to the preferred aspect of the present embodiment. The program exemplified above can be stored on a computer-readable storage medium and installed in a computer. The storage medium is, for example, a non-transitory storage medium, a good example of which is an optical storage medium, such as a CD-ROM (optical disc), but can include known arbitrary storage medium formats, such as semiconductor storage media and magnetic storage media. Furthermore, the program can be delivered to a computer in the form of distribution via a communication network.

(7) A preferred aspect of the present embodiment can also be specified as an operation method (automatic performance method) of the automatic performance system 100 according to the above-described embodiment. For example, in the automatic performance method according to a preferred aspect of the present embodiment, a computer system (a system constituting a single computer or a plurality of computers) detects the cueing motion of the performer P that performs the musical piece to be performed (SA1); sequentially estimates the performance position T in the musical piece to be performed by analyzing the audio signal A, which represents the sound that is played, parallel with the performance (SA2); causes the automatic performance device 24 to carry out the automatic performance of the musical piece to be performed so as to be synchronized with the cueing motion and the progress of the performance position T (SA3); and causes the display device 26 to display the performance image G which represents the progress of the automatic performance (SA4).

(8) In the above-mentioned embodiment, both the performance tempo and the performance volume are reflected in the music data M, but it is also possible to reflect only one of the performance tempo and the performance volume in the music data M. That is, one of the first updating module 91 and the second updating module 92 illustrated in FIG. 9 can be omitted.

(9) For example, the following configurations can be understood from the embodiments exemplified above.

Aspect A1

The music data processing method according to a preferred aspect (aspect A1) of the present embodiment comprises: estimating a performance position within a musical piece by means of analyzing an audio signal that represents a performance sound; updating a tempo designated by music data that represent a performance content of the musical piece, such that a tempo trajectory corresponds to transitions in a degree of dispersion of a performance tempo, which is generated as a result of estimating the performance position with respect to a plurality of performances of the musical piece, and the transitions in the degree of dispersion of a reference tempo, which has been prepared in advance; and, when updating the music data, updating the tempo designated by the music data, such that the performance tempo is preferentially reflected in portions of the musical piece in which the degree of dispersion of the performance tempo falls below the degree of dispersion of the reference tempo, and the reference tempo is preferentially reflected in portions of the musical piece in which the degree of dispersion of the performance tempo exceeds the degree of dispersion of the reference tempo. By means of the aspect described above, it is possible to reflect the tendency of the performance tempo in the actual performance (for example, a rehearsal) on the music data M.

Aspect A2

In a preferred example (aspect A2) of the first aspect, a basis vector of each musical note and a change in volume designated for each musical note by the music data are updated such that a reference matrix, which is obtained by adding, for a plurality of the musical notes, a product of the basis vector that represents a spectrum of a performance sound that corresponds to a musical note and a coefficient vector that represents the change in the volume designated for the musical note by the music data, approaches an observation matrix that represents a spectrogram of the audio signal. According to the aspect described above, it is possible to reflect the tendency of the performance volume in the actual performance on the music data M.

Aspect A3

In a preferred example (aspect A3) of the second aspect, in the updating of the change in the volume, the change in the volume designated for each musical note by the music data is expanded/contracted on a time axis in accordance with a result of estimating the performance position, and the coefficient matrix that represents the change in the volume after the expansion/contraction is used. In the aspect described above, the coefficient matrix, obtained by expanding/contracting the change in the volume designated for each musical note by the music data in accordance with the estimation result of the performance position, is used. Accordingly, it is possible to appropriately reflect the tendency of the performance volume in the actual performance in the music data, even when the performance tempo varies.

Aspect A4

A program according to a preferred aspect (aspect A4) of the present embodiment causes a computer to function as a performance analysis module for estimating a performance position in a musical piece by means of analyzing an audio signal that represents a performance sound; and as a first updating module for updating a tempo designated by music data that represent a performance content of the musical piece, such that a tempo trajectory corresponds to transitions in a degree of dispersion of a performance tempo, which is generated as a result of estimating the performance positions, and the transitions in the degree of dispersion of a reference tempo, which has been prepared in advance, with respect to a plurality of performances of the musical piece; wherein, when the music data is updated, the first updating module updates the tempo designated by the music data, such that the performance tempo is preferentially reflected in portions of the musical piece in which the degree of dispersion of the performance tempo falls below the degree of dispersion of the reference tempo, and the reference tempo is preferentially reflected in portions of the musical piece in which the degree of dispersion of the performance tempo exceeds the degree of dispersion of the reference tempo. According to the aspect described above, it is possible to reflect the tendency of the performance tempo in the actual performance (for example, a rehearsal) on the music data M.

(10) For example, the following configurations can be understood regarding the automatic performance system exemplified in the above-mentioned embodiment.

Aspect B1

An automatic performance system according to a preferred aspect (aspect B1) of the present embodiment comprises: a cue detection module for detecting a cueing motion of a performer that performs a musical piece; a performance analysis module for sequentially estimating a performance position within the musical piece by analyzing an audio signal, which represents a sound that is played, parallel with the performance; a performance control module that causes an automatic performance device to carry out an automatic performance of the musical piece so as to be synchronized with the cueing motion detected by the cue detection module and the progress of the performance position estimated by the performance analysis module; and a display control module that causes a display device to display an image, which represents the progress of the automatic performance. According to the configuration described above, the automatic performance by the automatic performance device is carried out so as to be synchronized with the cueing motion of the performer and the progress of the performance position, while the display device displays the image representing the progress of the automatic performance of the automatic performance device. Accordingly, the performer can visually check the progress of the automatic performance of the automatic performance device, and can reflect the visual confirmation in the performer's own performance. That is, a natural ensemble is realized, in which the performance of the performer and the automatic performance of the automatic performance device interact.

Aspect B2

In a preferred example (aspect B2) of aspect B1, the performance control module instructs the automatic performance device regarding the performance at a point in time that is later in the musical piece relative to the performance position as estimated by the performance analysis module. By means of the aspect described above the automatic performance device is instructed regarding the performance content at a point in time that is later than the performance position as estimated by the performance analysis module. Accordingly, even when the actual generation of sound from the automatic performance device is delayed with respect to the instruction of the performance by the performance control module, it is possible to synchronize the performance of the performer and the automatic performance with high precision.

Aspect B3

In a preferred example (aspect B3) of aspect B2, a performance analysis module estimates a performance speed by analyzing an audio signal, and the performance control module provides instruction to the automatic performance device regarding the performance at a point in time that is later in the musical piece, relative to the performance position, by an adjustment amount corresponding to the performance speed as estimated by the performance analysis module. By means of the aspect described above, the automatic performance device is instructed to perform at the time point that is ahead of the performance position by an adjustment amount that varies in accordance with the performance speed as estimated by the performance analysis module. Accordingly, for example, even when the performance speed varies, the performance of the performer and the automatic performance can be synchronized with high precision.

Aspect B4

In a preferred example (aspect B4) of any one of aspect B1 to aspect B3, the cue detection module detects the cueing motion by analyzing an image that captures the performer taken by an image capture device. According to the aspect described above, since cueing motion of the performer is detected by analyzing the image captured by the image capture device, there is the benefit of the ability to detect the cueing motion with reduced influence on the performance of the performer, compared to a case in which the cueing motion is detected, for example, by means of a detector mounted on the performer's body.

Aspect B5

In a preferred example (aspect B5) of any one of aspect B1 to aspect B4, a display control module causes the display device to display an image that changes dynamically in accordance with the performance content of the automatic performance. According to the aspect described above, there is the benefit that since an image that changes dynamically in accordance with the performance content of the automatic performance is displayed on the display device, the performer can visually and intuitively grasp the progress of the automatic performance.

Aspect B6

In an automatic performance method according to a preferred aspect (aspect B6) of the present embodiment, a computer system detects a cueing motion of a performer that performs a musical piece; sequentially estimates a performance position within the musical piece by analyzing an audio signal, which represents a sound that is played, parallel with the performance; causes an automatic performance device to carry out an automatic performance of the musical piece so as to be synchronized with the cueing motion and the progress of the performance position; and causes a display device to display an image, which represents the progress of the automatic performance.

DETAILED DESCRIPTION

The preferred aspects of the present embodiment can be expressed as follows.

1. Premise

An automatic performance system is a system in which a machine generates an accompaniment in accordance with a human performance. Discussed here is an automatic performance system in which musical score expressions, such as classical music to be played by the automatic performance system and human performers are provided. Such an automatic performance system has a wide range of applications, such as practice support for music performances, expanded musical expressions, in which electronics are driven in accordance with the performer. Hereinbelow, a part that is performed by an ensemble engine will be referred to as an "accompaniment part". In order to carry out a musically matching ensemble, it is necessary to appropriately control the performance timing of the accompaniment part. There are four requirements for appropriate timing control, as described below.

Requirement 1

In principle, the automatic performance system must play in the same places that are being played by the human player. Accordingly, the automatic performance system must coordinate the positions of the musical piece being played with the performance by the human performer. Particularly with classical music, since the cadence of the performance speed (tempo) is important for musical expression, it is necessary that changes in the performer's tempo be followed. In addition, in order to follow with higher precision, it is preferable to capture the habits of the performer by analyzing the performer's practice (rehearsal).

Requirement 2

The automatic performance system should generate a musically consistent performance. In other words, it is necessary that the human performance be followed within a performance range in which the musicality of the accompaniment part is maintained.

Requirement 3

It should be possible to change the degree to which the accompaniment part is coordinated with the performer (master/slave relationship), according to the context of the musical piece. In a musical piece, there are locations where coordination with human performers should be prioritized even at the expense of a certain amount of musicality, and there are locations where the musicality of the accompaniment part should be maintained even if the following ability is impaired. Accordingly, the balance between "following ability" and "musicality" respectively described in Requirement 1 and Requirement 2 changes depending on the context of the musical piece. For example, parts with an unclear rhythm tend to follow parts in which the rhythm is more clearly maintained.

Requirement 4

It should be possible to immediately change the master/slave relationship according to an instruction from the performer. The trade-off between the following ability and the musicality of the automatic performance system is often adjusted through dialogue between human performers during rehearsal. In addition, when such an adjustment is made, the result of the adjustment is checked by replaying the location where the adjustment was made. Therefore, an automatic performance system that allows setting the behavior of the following ability during rehearsal is necessary.

In order to satisfy these requirements at the same time, it is necessary to generate the accompaniment part that does not break down musically as the position that is being played by the performer is followed. In order to realize the foregoing, the automatic performance system requires three elements: (1) a model predicting the performer's position; (2) a timing generation model for generating a musical accompaniment part; and (3) a model for correcting the performance timing in accordance with the master/slave relationship. In addition, it must be possible to independently manipulate or learn these elements. However, conventionally, it has been difficult to independently handle these elements. Therefore, in the following description, independently modeling and integrating the following three elements will be considered: (1) a process for generating the performance timing of the performer; (2) a process for generating the performance timing that expresses the range that the automatic performance system can perform musically; and (3) a process for coupling the performance timings of the performer and the automatic performance system in order for the automatic performance system to be coordinated with the performer while maintaining the master/slave relationship. It becomes possible to independently learn and manipulate each of the elements by means of independent expression. When the system is used, the process for generating the performer's timing is inferred as the range of the timings at which the automatic performance system can play is inferred, and the accompaniment part is reproduced so as to coordinate the timings of the ensemble and the performer. It thereby becomes possible for the automatic performance system to perform a musically cohesive ensemble in coordination with human performers.

2. Related Technology

In a conventional automatic performance system, the performance timing of the performer is estimated using musical score tracking. On this basis, there are generally two approaches that are used in order to coordinate the ensemble engine and human performers. First, capturing the average behavior in a musical piece or behavior that changes from moment to moment, by subjecting the relationship of the performer with the performance timing of the ensemble engine to regression analysis through numerous rehearsals, has been suggested. With such an approach, the results of the ensemble themselves are subjected to regression analysis; as a result, the musicality of the accompaniment part and the following ability of the accompaniment part can be captured simultaneously. However, because it is difficult to separately express the timing prediction of the performer, the process of generating the ensemble engine, and the degree of matching, it is difficult to independently manipulate the musicality or the following ability during a rehearsal. In addition, in order to capture the music following ability, it is necessary to separately analyze data of ensembles among human beings, which results in high content development costs. A second approach imposes constraints on the tempo trajectory by using a dynamic system that is described using a small number of parameters. According to this approach, prior information such as the tempo continuity is provided, and the tempo trajectory of the performer is learned through rehearsal. In addition, in regard to the accompaniment part, the sound generation timing of the accompaniment part can be learned separately. Since the tempo trajectory is described using a small number of parameters, the accompaniment part or human "habits" can be easily manually overwritten during rehearsal. However, it is difficult to manipulate the following ability independently; thus, the following ability was obtained indirectly from variations in the sound generation timing, when the performer and the ensemble engine performed independently. In order to increase the spontaneity during a rehearsal, it is effective to alternately carry out learning by the automatic performance system and a dialogue between the automatic performance system and the performer. Therefore, a method that adjusts the ensemble reproduction logic itself in order to independently manipulate the following ability has been proposed. In the present method, based on such an idea, a mathematical model with which it is possible to independently and interactively control the "manner of coordination," "performance timing of the accompaniment part," and "performance timing of the performer" will be considered.

3. System Overview

Figure 15:
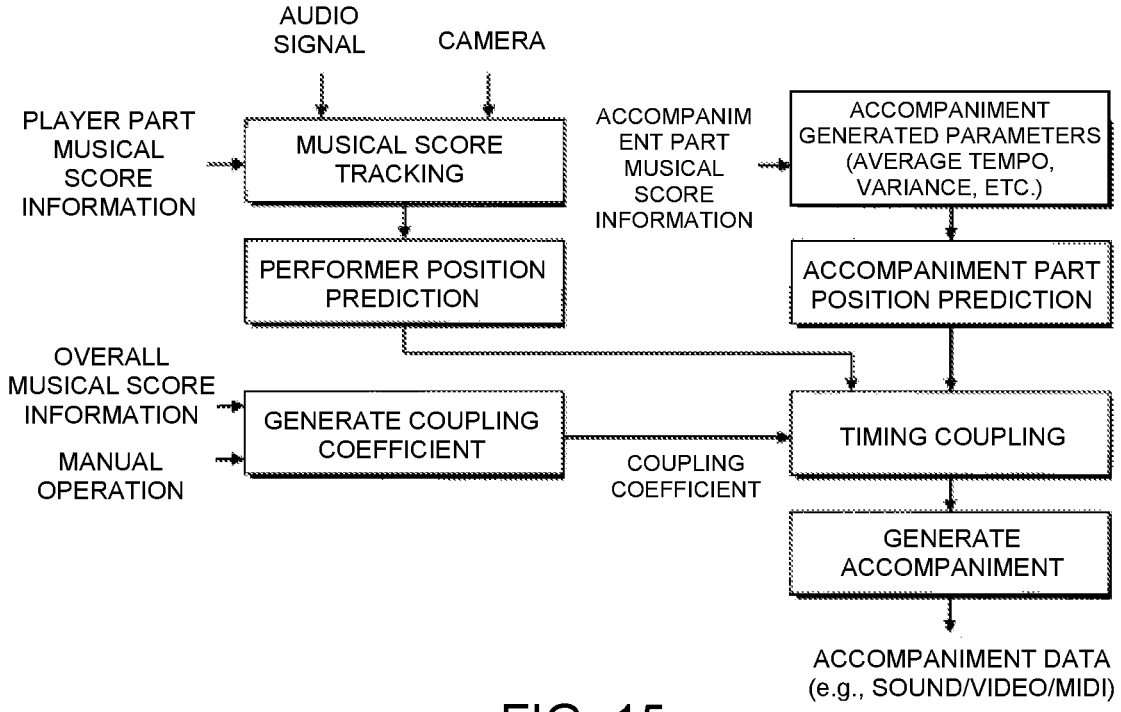
FIG. 15 is a block diagram of the automatic performance system.

The configuration of the automatic performance system is illustrated in FIG. 15. In the present method, musical score tracking is carried out based on an audio signal and a camera image in order to follow the performer's position. In addition, based on statistical information obtained from posterior distribution of the musical score tracking, the performer's position is predicted based on a process for generating the position that is being played by the performer. In order to determine the sound generation timing of the accompaniment part, the timing of the accompaniment part is generated by coupling a model that predicts the timing of the performer and the process for generating the timing that the accompaniment part assume.

4. Score Following

Score following is used in order to estimate the position in the musical piece that is currently being played by the performer. In the score following method of the present system, a discrete state space model that simultaneously expresses the position in the musical score and the tempo that is being played will be considered. An observed sound is modeled as a hidden Markov model (HMM) in a state space, and the posterior distribution of the state space is sequentially estimated using a delayed-decision type forward-backward algorithm. A delayed-decision forward-backward algorithm, i.e., a method in which a forward algorithm is sequentially executed and a backward algorithm is run by assuming that the current time is the end of the data, is used to compute the posterior distribution for the state of several frames before the current time. A Laplace approximation of the posterior distribution is output at the point in time at which the MAP value of the posterior distribution passes the position considered to be the onset of the musical score.

The structure of the state space will be described. First, the musical piece is divided into R segments, and each segment is set as one state. The segment r has, as state variables, the number n of frames that must be elapsed by the segment, and the current elapsed frame $0 \le l < n$ for each n. That is, n corresponds to the tempo of a certain segment, and the combination of r and l corresponds to the position in the musical score. The transitions in this state space can then be expressed as a Markov process, as follows.

Equation (1) Self-transition from (r, n, l): p (2) Transition from (r, n, l<n) to (r, n, l+1): 1−p (3) Transition from (r, n, n−l) to (r+l, n', 0):

$$(1-p)\frac{1}{2\lambda^{(T)}}e^{-\lambda^{(T)}|n'-n|}$$

Such a model combines the features of an explicit-duration HMM and a left-to-right HMM. That is, by selecting n, it is possible to absorb minute tempo variations in the segment with the self-transition probability p, while approximating the duration of the segment. The self-transition probability or the length of the segment is obtained by analyzing the music data. Specifically, annotation information such as a fermata or a tempo command is used.

Next, the observation likelihood of such a model is defined. Each state (r, n, l) has a corresponding position in the musical piece, denoted $\bar{s}(r, n, l)$. In addition to the mean values $/\bar{c}_s^2$ and $/\Delta\bar{c}_d^2$ of observed constant-Q transform (CQT) and ΔCQT, precision $\kappa_s(c)$ and $/\kappa_s^{(\Delta c)}$ are respectively assigned to an arbitrary position s in the musical piece (the / symbol signifies a vector, and the $\bar{}$ symbol signifies an overbar in a mathematical expression). On this basis, when CQT, $c_t$, ΔCQT, and $\Delta c_t$ are observed at time t, the observation likelihood corresponding to the state $(r_t, n_t, l_t)$ is defined as follows.

Equation $$p(c_t, \Delta c_t \mid (r_t, n_t, l_t), \lambda, \{\bar{c}_s\}_{s=1}^{S}, \{\Delta\bar{c}_s\}_{s=1}^{S}) = vMF\left(c_t \mid \bar{c}_{s(r_t,n_t,l_t)}, \kappa^{(c)}_{\bar{s}(r_t,n_t,l_t)}\right) \times vMF\left(\Delta c_t \mid \Delta\bar{c}_{s(r_t,n_t,l_t)}, \kappa^{(c)}_{\bar{s}(r_t,n_t,l_t)}\right). \quad (1)$$

Here, vMF (x|μ, κ) refers to a von Mises-Fisher distribution, which, specifically, is normalized so as to satisfy $x \varepsilon S^D$ (SD: D-1 dimensional unit sphere) and expressed by means of the following equation.

Equation $$vMF(x \mid \mu, \kappa) \propto \frac{\kappa^{D/2-1}}{I_{D/2-1}(\kappa)}\exp(\kappa\mu' x)$$

A piano roll of musical score expressions and a CQT model assumed from each sound are used when determining $\bar{c}$ or $\Delta\bar{c}$. First, a unique index i is assigned to the pair comprising the pitch on the musical score and a musical instrument name. In addition, an average observation $CQT\omega_{if}$ is assigned to the i-th sound. If the intensity of the i-th sound at position s on the musical score is set to $h_{is}$, $\bar{c}_{s,f}$ can be found as follows. $\Delta\bar{c}$ can be obtained by taking the primary difference in the s direction with respect to $\bar{c}_{s,f}$ and half-wave rectifying.

Equation $$\bar{c}_{s,f} = \sum_i h_{s,i}\omega_{i,f}$$

When a musical piece is started from a silent state, visual information becomes more important. Therefore, in the present system, a cueing motion (cue) detected by a camera disposed in front of the performer is used, as described above. By means of this method, the audio signal and the cueing motion are handled in an integrated manner by directly reflecting the presence/absence of the cueing motion on the observation likelihood, as opposed to an approach in which the automatic performance system is controlled in a top-down manner. Therefore, the location ($\hat{q}_i$) where the cueing motion is required for the musical score information is first extracted. $\hat{q}_i$ includes positions of fermatas or the starting point of the musical piece. When the cueing motion is detected as the musical score is being tracked, the observation likelihood of the state corresponding to a position U [$\hat{q}_i$−T, $\hat{q}_i$] on the musical score is set to 0, thereby guiding the posterior distribution to a position after the cueing motion. Due to the musical score tracking, the ensemble engine receives a tempo distribution or approximation of the currently estimated position as a normal distribution, several frames after the position where the sound was switched in the musical score. That is, when the n-th sound change in the music data (hereinafter referred to as "onset event") is detected, the musical score tracking engine reports a time stamp $t_n$ of the time at which the onset event is detected, an estimated mean position μn in the musical score, and variance $\sigma_n^2$ thereof, to the ensemble engine. Moreover, since a delayed-decision estimation is carried out, the notification itself is delayed 100 ms.

5. Performance Timing Coupling Model

The ensemble engine computes the appropriate reproduction position of the ensemble engine based on the information ($t_n$, $\mu_n$, $\sigma_n^2$) reported by the score tracking. In order for the ensemble engine to follow the lead of the performer, it is preferred that the following three processes be independently modeled: (1) the process for generating the timing at which the performer plays; (2) the process for generating the timing at which the accompaniment part plays; and (3) the process for the accompaniment part to play while listening to the performer. Using such a model, the final timings of the accompaniment part are generated, taking into consideration the performance timing that the accompaniment part wants to generate and the predicted position of the performer.

5.1 Process for Generating the Performance Timing of the Performer

In order to express the performance timing of the performer, it is assumed that the performer is moving linearly at a position on the musical score between $t_n$ and $t_{n+1}$ at a velocity $v_n^{(p)}$. That is, the following generation process is considered, assuming $x_n^{(p)}$ to be the score position at which the performer plays at $t_n$, and $\varepsilon_n^{(p)}$ to be noise with respect to the velocity or the score position. Here $\Delta T_{m,n}=t_m-t_n$.

Equation $$x_n^{(p)}=x_{n-1}^{(p)}+\Delta T_{n,n-1}v_{n-1}^{(p)}+\in_{n,0}^{(p)},$$

$$v_n^{(p)}=v_{n-1}^{(p)}+\in_{n,1}^{(p)}$$

Noise $\varepsilon_n^{(p)}$ includes, in addition to change in the tempo, agogics or pronunciation timing error. In order to represent the former, consider a model that transitions between $t_n$ and $t_{n-1}$ at an acceleration generated from the normal distribution of the variance $\varphi^2$, while taking into account the fact that the sound generation timing changes with changes in tempo. Then, assuming that $h=[\Delta T_{n,n-1}^2/2,\ \Delta T_{n,n-1}]$, the covariance matrix of $\varepsilon_n^{(p)}$ is given by $\Sigma_n^{(p)}=\varphi^2 h'h$; thus, the change in the tempo and the change in the sound generation timing become correlated with each other. In addition, in order to represent the latter, consider white noise with standard deviation $\sigma_n^{(P)}$, and $\sigma_n^{(p)}$ is added to $\Sigma_{n,0,0}^{(p)}$. Accordingly, when the matrix obtained by adding $\sigma_n^{(p)}$ to $\Sigma_{0,0}^{(p)}$ is $\Sigma_n^{(p)}$ to N(O, $\Sigma^{(P)}$) is obtained. N(a, b) denotes a normal distribution of the mean a and the variance b.

Next, let us consider tying the history of the user's performance timings $/\mu_n=[\mu_n, \mu_{n-1}, \ldots, \mu_{n-ln}]$ and $/\sigma_n^2=[\sigma_n, \sigma_{n-1}, \ldots, \sigma_{n-ln}]$ reported by the musical score tracking system to Equation (3) and Equation (4). Here, $l_n$ is the length of the history to be considered, and is set to include up to the event of one beat before $t_n$. The generation process of $/\mu_n$ and $/\sigma_n^2$ is defined as follows.

Equation $$\mu_n \sim \mathcal{N}^c(W_n[x_n^{(p)} v_n^{(p)}],\ \mathrm{diag}(\sigma_n^2))$$

$$\mathcal{N}^c(x \mid \mu, \Sigma) = \frac{1}{2\sqrt{|\Sigma|}}\exp\left(-\frac{1}{2}(x-\mu)'\Sigma^{-1}(x-\mu)\right)$$

Here, $/W_n$ is a regression coefficient for predicting an observation $/\mu_n$ from $x_n^{(p)}$ and $v_n^{(p)}$. Here, $/W_n$ is defined as follows.

Equation $$W_n^T = \begin{pmatrix} 1 & 1 & \ldots & 1 \\ \Delta T_{n,n} & \Delta T_{n,n-1} & \ldots & \Delta T_{n,n-1_n+1} \end{pmatrix} \tag{6}$$

As in the prior art, it is thought that by using, instead of the latest μn, the history prior thereto, the operation is less likely to break down even if the musical score tracking partially fails. In addition, it is also thought that it is possible to acquire $/W_n$ through rehearsal, and that it will also become possible to track a performance method that depends on long-term trends, such as the pattern of tempo increase/decrease. Such a model corresponds to applying the concept of trajectory-HMM to a continuous state space, in the sense that the relationship between the tempo and the change in score position is clearly stated.

5.2 Process for Generating the Performance Timing of the Accompaniment Part

By using the performer's timing model as described above, it is possible to infer the internal state [$X_n^{(p)}$, $V_n^{(p)}$] of the performer from the history of the position reported by the musical score tracking. The automatic performance system infers the final sound generation timing while harmonizing such an inference with the habit of how the accompaniment part "wants to play." Therefore, the process for generating the performance timing in the accompaniment part will be considered here, regarding how the accompaniment part "wants to play."

With the performance timing of the accompaniment part, a process for performing with a tempo trajectory that is within a set range from the provided tempo trajectory will be considered. It is conceivable to use human performance data or a performance expression supplying system for the provided tempo trajectory. When the automatic performance system receives the n-th onset event, the predicted value $X_n^{(a)}$ of which position in the musical piece is being played and the relative speed $V_n^{(a)}$ thereof are expressed as follows.

Equation $$\hat{x}_n^{(a)}=x_{n-1}^{(a)}+\Delta T_{n,n-1}v_{n-1}^{(a)}+\in_{n,0}^{(a)} \quad (7)$$

$$\hat{v}_n^{(a)}=\beta v_{n-1}^{(a)}+(1-\beta)\bar{v}_n^{(a)}+\in_{n,1}^{(a)} \quad (8)$$

Here, $\bar{v}_n^{(a)}$ is the tempo provided in advance at position n in the musical score reported at time $t_n$, and the tempo trajectory given in advance is substituted. In addition, $\varepsilon^{(a)}$ defines the range of deviation that is allowed with respect to the performance timing that is generated from the tempo trajectory given in advance. With such parameters, the range of a musically natural performance as the accompaniment part is determined. $\beta\in[0, 1]$ is a term that indicates how strongly the tempo should be pulled back to the tempo given in advance, and has the effect of attempting to bring the tempo trajectory back to $\bar{V}_n^{(a)}$. Since such a model has a certain effect in audio alignment, it is suggested that it has validity as a process for generating the timings for performing the same musical piece. When such a constraint is not present ($\beta=1$), $\hat{v}$ follows the Wiener process; thus, the tempo diverges and a performance that is extremely fast or slow can be generated.

5.3 Process for Coupling the Performance Timings of the Performer and the Accompaniment Part Up to this point, the sound generation timing of the performer and the sound generation timing of the accompaniment part were independently modeled. Here, a process in which the accompaniment part "follows" of the performer while listening to the performer will be described, based on these generation processes. Therefore, let us consider describing a behavior for gradually correcting the error between the predicted value of the position that the accompaniment part is currently attempting to play and the predicted value of the performer's current position when the accompaniment part follows the lead of a person. Hereinbelow, such a variable describing the degree to which the error is corrected will be referred to as the "coupling coefficient." The coupling coefficient is affected by the master/slave relationship between the accompaniment part and the performer. For example, if the performer is keeping a clearer rhythm than the accompaniment part, the accompaniment part often tries to strongly follow the lead of the performer. In addition, when the performer provides instruction regarding the master/slave relationship during rehearsal, it is necessary to change the manner of coordination as instructed. That is, the coupling coefficient changes according to the context of the musical piece or a dialogue with the performer. Therefore, when the coupling coefficient $\gamma_n\in[0, 1]$ is given at the musical score position when $t_n$ is received, the process in which the accompaniment part follows the lead of the performer is described as follows.

Equation $$x_n^{(a)}=\hat{x}_n^{(a)}+\gamma_n(x_n^{(p)}-\hat{x}_n^{(a)}) \quad (9)$$

$$v_n^{(a)}=\hat{v}_n^{(a)}+\gamma_n(v_n^{(p)}-\hat{v}_n^{(a)}) \quad (10)$$

In this model, the tracking degree changes according to the magnitude of $\gamma_n$. For example, when $\gamma_n=0$, the accompaniment part does not follow the lead of the performer at all; and when $\gamma_n=1$, the accompaniment part attempts to follow the lead of the performer exactly. In such a model, the variance of the performance $\hat{x}_n^{(a)}$ that the accompaniment part can play and the prediction error at the performance timing $x_n^{(p)}$ of the performer are also weighted by the coupling coefficient. Therefore, the variance of $x^{(a)}$ or $v^{(a)}$ becomes one in which the performer's performance timing probability process itself and the accompaniment part's performance timing probability process itself are harmonized. Thus, it can be seen that the tempo trajectories that the performer and the automatic performance system "want to generate" can be naturally integrated.

Figure 16:
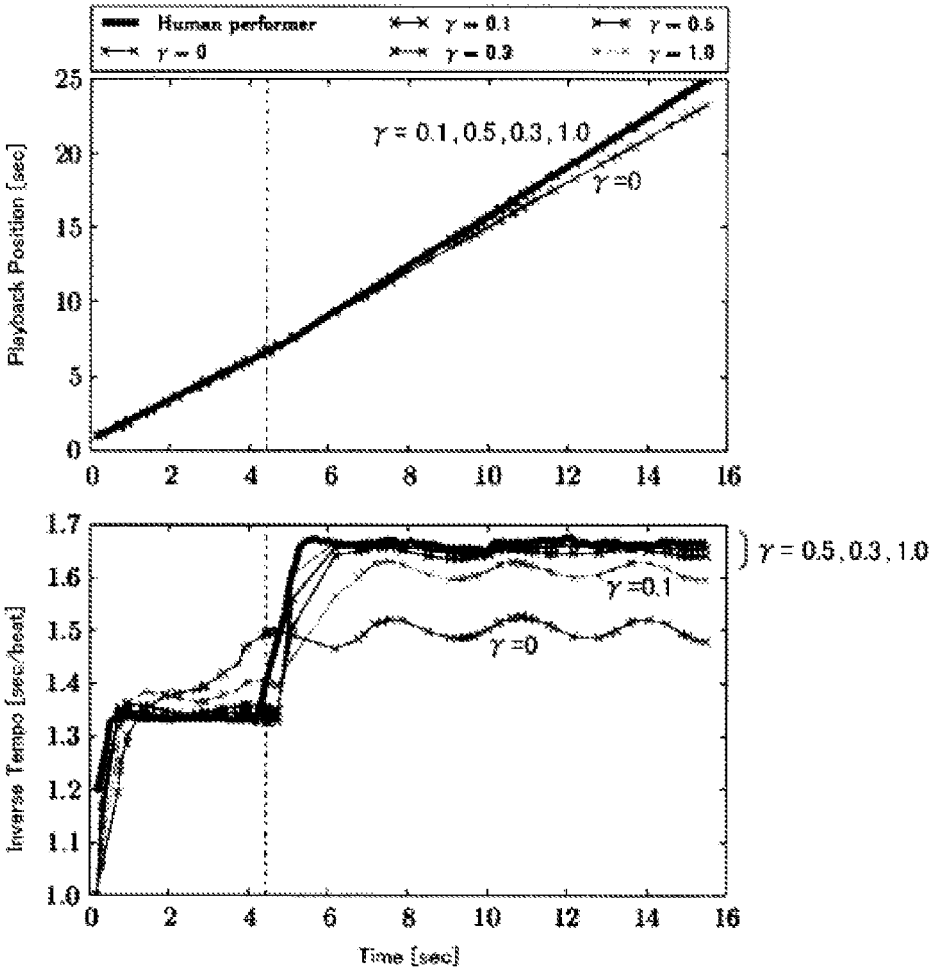
FIG. 16 is simulation result of sound generation timing of a performer and sound generation timing of an accompaniment part.

A simulation of this model with $\beta=0.9$ is illustrated in FIG. 16. It can be seen that by changing $\gamma$ in this manner, the space between the tempo trajectory of the accompaniment part (sine wave) and the tempo trajectory of the performer (step function) can be complemented. In addition, it can be seen that, due to the effect of $\beta$, the generated tempo trajectory is made to be closer to the tempo trajectory target of the accompaniment part than the tempo trajectory of the performer. In other words, it is thought that there is an effect to "pull" the performer if the performer is faster than $\bar{v}<^{(a)}$, and to "rush" the performer if the performer is slower.

5.4 Method for Calculating the Coupling Coefficient $\gamma$

The degree of synchronization between performers as represented by the coupling coefficient $\gamma_n$ is set based on several factors. First the master/slave relationship is affected by the context in the musical piece. For example, a part that keeps an easy-to-understand rhythm often tends to lead the ensemble. In addition, there are cases in which the master/slave relationship changes through dialogue. In order to set the master/slave relationship from the context in the musical piece, sound density $\varphi_n$=[moving average of the density of musical notes with respect to the accompaniment part, moving average of the density of the musical notes with respect to the performer part] is calculated from the musical score information. Since it is easier to determine the tempo trajectory for a part that has a large number of sounds, it is thought that an approximate coupling coefficient can be extracted by using such feature amounts. At this time, behavior in which the position prediction of the ensemble is entirely dominated by the performer when the accompaniment part is not performing ($\varphi_{n,0}=0$), and behavior in which the position prediction of the ensemble completely ignores the performer in locations in which the performer does not play ($\varphi_{n,1}=0$), are desirable. Accordingly, $\gamma n$ is determined as follows.

Equation $$\gamma_n = \frac{\phi_{n,1} + \epsilon}{\phi_{n,1} + \phi_{n,0} + 2\epsilon}$$

Where $\varepsilon>0$ shall be a sufficiently small value. In an ensemble between human performers, a completely one-sided master/slave relationship ($\gamma_n=0$ of $\gamma_n=1$) does not tend to occur; similarly, a heuristic like the expression above does not become a completely one-sided master/slave relationship, when both the performer and the accompaniment part are playing. A completely one-sided master/slave relationship occurs only when either the performer or the ensemble engine is silent for a while, but this behavior is actually desirable.

In addition, $\gamma_n$ can be overwritten by the performer or an operator during rehearsal, or the like, when necessary. The fact that the domain of $\gamma_n$ is finite, and that the behavior thereof under the boundary conditions is obvious, or the fact that the behavior continuously changes with respect to variations in $\gamma_n$, are thought to be desirable characteristics, when a human performer overwrites with an appropriate value during rehearsal.

5.5 Online Inference

When the automatic performance system is operated, the posterior distribution of the above-mentioned performance timing model is updated at the timing that $(t_n, \mu_n, \sigma_n^2)$ is received. The proposed method can be efficiently inferred using a Kalman filter. The predict and update steps of the Kalman filter are executed at the point in time at which $(t_n, \mu_n, \sigma_n^2)$ is notified, and the position that the accompaniment part should play at time t is predicted as follows.

Equation $$x_n^{(a)}+(\tau^{(s)}+t-t_n)v_n^{(a)}$$

Here, $\tau^{(s)}$ is the input/output delay in the automatic performance system. In the present system, the state variable is also updated at the time of sound generation of the accompaniment part. That is, as described above, in addition to executing the predict/update steps in accordance with the result of the musical score tracking, only the predict step is carried out at the point in time at which the accompaniment part generates sound, and the obtained predicted value is substituted into the state variable.

6. Evaluation Experiment

In order to evaluate the present system, first, the accuracy of the performer's position estimation is evaluated. Regarding the timing generation for the ensemble, the usefulness of $\beta$, which is a term for attempting to pull back the ensemble's tempo to a defined value, or of $\gamma$, which is an index of to what degree the accompaniment part follows the performer, is evaluated by carrying out a hearing of the performers.

6.1 Evaluation of the Musical Score Tracking

In order to evaluate the accuracy of the musical score tracking, the tracking accuracy with respect to the Bergmüller Etudes was evaluated. Of Bergmüller Etude (Op. 100), fourteen pieces (No. 1, Nos. 4 to 10, No. 14, No. 15, No. 19, No. 20, No. 22, and No. 23) were played by a pianist, and the recorded data thereof were used as the evaluation data, in order to evaluate the score tracking accuracy. Camera input was not used in this experiment. MIREX was followed for the evaluation scale, and the total precision was evaluated. Total precision indicates precision with respect to the entire corpus, when the alignment error falls within a certain threshold $\tau$ is considered a correct answer.

Figure 17:
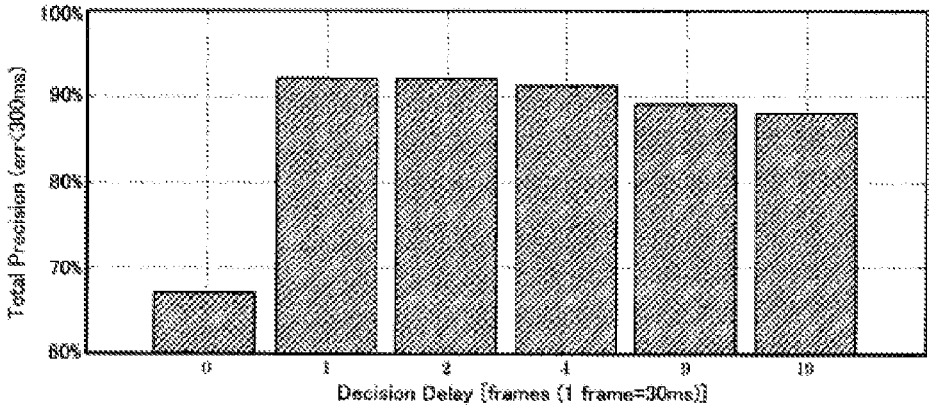
FIG. 17 is an evaluation result of the automatic performance system.

First, in order to verify the usefulness of the delayed-decision type inference, the total precision ($\tau$=300 ms) with respect to the delayed frame amount in the delayed-decision forward-backward algorithm was evaluated. The result is shown in FIG. 17. It can be seen that the precision increases by utilizing the posterior distribution of the result of several frames prior. In addition, it can be seen that the precision gradually decreases when the delay amount exceeds two frames. In addition, when the delay amount was two frames, total precision was 82% at $\tau$=100 ms, and 64% at $\tau$=50 ms.

6.2 Verification of the Performance Timing Coupling Model

The performance timing coupling model was verified through a hearing of the performers. The present model is characterized by the presence of $\beta$ with which the ensemble engine tries to pull back the tempo to an assumed tempo and of the coupling coefficient $\gamma$, and thus the effectiveness of these two parameters was verified.

First, in order to eliminate the effect of the coupling coefficient, a system in which Equation (4) is set to $v_n^{(p)}=\beta v_{n-1}^{(p)}+(1-\beta)\bar{v}_n^{(a)}$, and in which $x_n^{(a)}=x_n(p)$ and $v_n^{(a)}=v_n^{(p)}$ was prepared. That is, assuming a dynamic in which the anticipated value of the tempo is in $\bar{V}$ and the variance thereof is controlled by $\beta$, an ensemble engine that directly uses the result of filtering the result of the musical score tracking for generating the performance timing of the accompaniment was considered. First, six pianists were asked to use an automatic performance system wherein $\beta$ is set to 0 for one day, after which a hearing was conducted regarding the feeling of use. The target musical pieces were selected from a wide range of genres, such as classical, romantic, and popular. According to the hearings, the predominant complaint was that when human performers attempt to follow the ensemble, the accompaniment part also attempts to follow the human performers, resulting in the tempo becoming extremely slow or fast. Such a phenomenon occurs when the system's response is slightly mismatched to the performer due to the fact that $\tau^{(s)}$ in Equation (12) is inappropriately set. For example, when the system's response is slightly earlier than expected, the user attempts to follow the system, which returned the response a little early, which increases the tempo. As a result, a system that follows the tempo returns a response even earlier, and the tempo continues to accelerate.

Next, the same musical pieces were used at $\beta$=0.1, and an experiment was conducted with five different pianists and one pianist who also participated in the $\beta$=0 experiment. A hearing was carried out using the same question content as the case for $\mu$=0, but the problem of diverging tempo was not raised. In addition, the pianist who also cooperated in the $\beta$=0 experiment commented that the following ability was improved. However, it was commented that the system lags or rushes the performer when there is a great discrepancy between the tempo assumed by the performer regarding a certain piece of music and the tempo which the system was about to pull back. This tendency was observed particularly when an unknown musical piece was played, that is, a case in which the performer does not know the "common-sense" tempo. From the foregoing, although a divergence in tempos can be prevented due to the effect of the system's attempting to pull the tempo back to a certain tempo, it has been suggested that if the interpretation of the tempo is extremely different from that of the accompaniment part, there is the impression of being rushed by the accompaniment part. In addition, it was also suggested that the following ability should be changed according to the context of the musical piece. This is because opinions relating to the degree of following, such as "should pull," "should try to coordinate more" depending on the characteristics of the musical piece, were primarily consistent.

Finally, when a professional string quartet was asked to use a system fixed to $\gamma$=0 and a system in which the $\gamma$ is adjusted according to the context of the performance, there were comments that the latter system was better behaved, suggesting its usefulness. However, in this verification, since the subjects knew that the latter system was the improved system, additional verification is therefore necessary, preferably by using the AB method, etc. Moreover, since there were several situations in which $\gamma$ was changed as a result of dialogue during rehearsal, it was suggested that changing the coupling coefficient during rehearsal is useful.

7. Preliminary Learning Process

In order to acquire the "habits" of the performer, $h_{si}$, $\omega_{if}$, and the tempo trajectory are estimated based on the MAP state $\hat{s}_t$ at time t calculated from the musical score tracking and the input feature sequence $\{c_t\}T_{t=1}$ thereof. These estimation methods will be briefly described. In the estimation of $h_{si}$ and $\omega_{if}$, the following Poisson-Gamma informed NMF model is considered for the estimation of the posterior distribution.

Equation $$c_{t,f} \sim \text{Poisson}\left(\sum_{i}^{I} h_{\hat{s}_t,i}\omega_{i,f}\right)$$

$$h_{s,i} \sim \text{Gamma}\left(a_0^{(h)} \cdot b_{0,s,i}^{(h)}\right)$$

$$\omega_{i,f} \sim \text{Gamma}\left(a_{i,f}^{(\omega)} \cdot b_{i,f}^{(\omega)}\right).$$

The superparameters appearing here are appropriately calculated from a musical instrument sound database or a piano roll for musical score expressions. The posterior distribution is approximately estimated using a variational Bayesian method. Specifically, the posterior distribution p (h, ω|c) is approximated in the form of q(h)q(w), the KL distance between the posterior distribution, and q(h_q(w) is minimized while introducing auxiliary variables. From the posterior distribution estimated in this manner, a MAP estimate of the parameter ω corresponding to the timbre of the musical instrument sound is stored and used in the subsequent system operation. It is also possible to use h, which corresponds to the intensity of the piano roll.

Next, the length of the segments of the musical piece played by the performer (i.e., the tempo trajectory) is estimated. Since tempo expression unique to the performer can be restored by estimating the tempo trajectory, the prediction of the performer's position is improved. However, if the number of rehearsals is small, the estimation of the tempo trajectory can be erroneous due to estimation errors or the like, and the precision of the position prediction deteriorates. Therefore, when the tempo trajectory is changed, first, advance information relating to the tempo trajectory is given, and only changing the tempo of the location where the performer's tempo trajectory consistently deviates from the advance information is considered. First, the degree of variation of the performer's tempo is calculated. The estimated value of the variation degree itself also becomes unstable if the number of rehearsals is small, so the distribution of the performer's tempo trajectory itself is also given a prior distribution. It is assumed that mean $\mu_s^{(p)}$ and variance $\lambda_s^{(p)}$ of the tempo when the performer is at position s in the musical piece follows N $(\mu_s^{(p)}|m_0, b_0\lambda_s(p)^{-1})$Gamma $(\lambda_s^{(p)-1}|a_0^{\lambda}, b_0^{\lambda})$. In that case, if the mean of the tempo obtained from K performances is $\mu_s^{(R)-1}$ and the precision (variance) is $\lambda_s^{(R)-1}$, the posterior distribution of the tempo is given as follows.

Equation $$q\left(\mu_s^{(P)} \cdot \lambda_s^{(P)-1}\right) = p\left(\mu_s^{(P)} \cdot \lambda_s^{(P)-1} \mid M \cdot \mu_s^{(R)} \cdot \lambda_s^{(R)}\right) = \mathcal{N}\left(\mu_s^{(P)} \middle| \frac{b_0 m_0 + M\mu_s^{(R)}}{b_0 + M} \cdot (b_0 + M)\lambda_s^{(p)-1}\right) \times \text{Gamma}\left(\lambda_s^{(p)} \middle| a_0^{\lambda} + \frac{M}{2} \cdot b_0^{\lambda} + \frac{1}{2}\left(M\lambda_s^{(R)-1} + \frac{Mb_0(\mu_s^{(R)} - m_0)^2}{M + b_0}\right)\right)$$

When a posterior distribution obtained in this manner is regarded as the distribution generated from the tempo distribution N $(\mu_s^{S}, \lambda_s^{S-1})$ that can be obtained at the position s in the musical piece, the mean value of the posterior distribution is given as follows.

Equation $$\langle \mu_s^{(S)} \rangle_{p(\mu_s^{(S)}|\mu_s^{(P)},\lambda_s^{(P)},M)} = \frac{\langle \lambda_s^{(P)} \rangle \mu_s^{(S)} + \lambda_s^{(S)} \langle \mu_s^{(P)} \rangle}{\lambda_s^{(S)} + \langle \mu_s^{(P)} \rangle}$$

Based on the tempo calculated in this manner, the average value of ε used in Equation (3) and Equation (4) is updated.

What is claims:

1. A music data processing method, comprising:

estimating a performance position within a musical piece by analyzing an audio signal that represents a performance sound; and updating a tempo designated by music data that represent a performance content of the musical piece, such that a tempo trajectory corresponds to a transition in a degree of dispersion of a performance tempo, which is generated as a result of estimating the performance position with respect to a plurality of performances of the musical piece, and a transition in a degree of dispersion of a reference tempo, which is prepared in advance, the tempo designated by the music data being updated such that the performance tempo is preferentially reflected in a portion of the musical piece in which the degree of dispersion of the performance tempo falls below the degree of dispersion of the reference tempo, and the reference tempo is preferentially reflected in a portion of the musical piece in which the degree of dispersion of the performance tempo exceeds the degree of dispersion of the reference tempo.

2. The music data processing method according to claim 1, further comprising updating a basis vector of each of a plurality of musical notes, which represents a spectrum of a performance sound that corresponds to each of the plurality of musical notes, and a change in a volume designated for each of the plurality of musical notes by the music data, such that a reference matrix, obtained by adding, for the plurality of the musical notes, a product of the basis vector and a coefficient vector that represents the change in the volume designated for each of the plurality of musical notes by the music data, approaches an observation matrix that represents a spectrogram of the audio signal.

3. The music data processing method according to claim 2, wherein the change in the volume designated for each of the plurality of musical notes by the music data is expanded or contracted on a time axis in accordance with the result of estimating the performance position, and a coefficient matrix that represents the change in the volume that has been expanded or contracted is used.

4. A non-transitory computer readable medium storing a program that causes a computer to function as:

a performance analysis module that estimates a performance position within a musical piece by analyzing an audio signal that represents a performance sound; and a first updating module that updates a tempo designated by music data that represent a performance content of the musical piece, such that a tempo trajectory corresponds to a transition in a degree of dispersion of a performance tempo, which is generated as a result of estimating the performance position with respect to a plurality of performances of the musical piece, and a transition in a degree of dispersion of a reference tempo, which is prepared in advance, the first updating module updating the tempo designated by the music data such that the performance tempo is preferentially reflected in a portion of the musical piece in which the degree of dispersion of the performance tempo falls below the degree of dispersion of the reference tempo, and the reference tempo is preferentially reflected in a portion of the musical piece in which the degree of dispersion of the performance tempo exceeds the degree of dispersion of the reference tempo.

5. The non-transitory computer readable medium according to claim 4, further comprising a second updating module that updates a basis vector of each of a plurality of musical notes, which represents a spectrum of a performance sound that corresponds to each of the plurality of musical notes, and a change in a volume designated for each of the plurality of musical notes by the music data, such that a reference matrix, obtained by adding, for the plurality of the musical notes, a product of the basis vector and a coefficient vector that represents the change in the volume designated for each of the plurality of musical notes by the music data, approaches an observation matrix that represents a spectrogram of the audio signal.

6. The non-transitory computer readable medium according to claim 5, wherein the second updating module expands or contracts the change in the volume designated for each of the plurality of musical notes by the music data on a time axis in accordance with the result of estimating of the performance position, and uses a coefficient matrix that represents the change in the volume that has been expanded or contracted.

7. A music data processing device, comprising:

an electronic controller including at least one processor, the electronic controller being configured to execute a plurality of modules including a performance analysis module that estimates a performance position within a musical piece by analyzing an audio signal that represents a performance sound; and a first updating module that updates a tempo designated by music data that represent a performance content of the musical piece, such that a tempo trajectory corresponds to a transition in a degree of dispersion of a performance tempo, which is generated as a result of estimating the performance position with respect to a plurality of performances of the musical piece, and a transition in a degree of dispersion of a reference tempo, which is prepared in advance, the first updating module updating the tempo designated by the music data such that the performance tempo is preferentially reflected in a portion of the musical piece in which the degree of dispersion of the performance tempo falls below the degree of dispersion of the reference tempo, and the reference tempo is preferentially reflected in a portion of the musical piece in which the degree of dispersion of the performance tempo exceeds the degree of dispersion of the reference tempo.

8. The music data processing device according to claim 7, wherein the electronic controller is configured to further execute a second updating module that updates a basis vector of each of a plurality of musical notes, which represents a spectrum of a performance sound that corresponds to each of the plurality of musical notes, and a change in a volume designated for each of the plurality of musical notes by the music data, such that a reference matrix, obtained by adding, for the plurality of the musical notes, a product of the basis vector and a coefficient vector that represents the change in the volume designated for each of the plurality of musical notes by the music data, approaches an observation matrix that represents a spectrogram of the audio signal.

9. The music data processing device according to claim 8, wherein the second updating module expands or contracts the change in the volume designated for each of the plurality of musical notes by the music data on a time axis in accordance with the result of estimating of the performance position, and uses a coefficient matrix that represents the change in the volume that has been expanded or contracted.

* * * * *